United States Patent [19]

Beaman

[11] 4,323,245

[45] Apr. 6, 1982

[54] AMUSEMENT DEVICE FORMED OF A PLURALITY OF DIFFERENTLY SHAPED INTERFITTING MODULAR UNITS

[76] Inventor: Robert D. Beaman, 608 Beech Dr., Newport News, Va. 23601

[21] Appl. No.: 237,662

[22] Filed: Feb. 24, 1981

[51] Int. Cl.[3] ..... A63F 9/12

[52] U.S. Cl. ..... 273/157 R; 46/25; 273/160; 434/211; 434/403

[58] Field of Search ..... 273/157 R, 160; 46/25; 434/211, 213, 278, 403

[56] References Cited

U.S. PATENT DOCUMENTS

| | | | |
|---|---|---|---|
| 595,782 | 12/1897 | Morsell | 434/211 |
| 639,941 | 12/1899 | Rossi-Diehl | 434/213 |
| 1,471,943 | 10/1923 | Chambers | 273/157 R |
| 2,041,030 | 5/1936 | Strutton | 273/157 R |
| 2,839,841 | 6/1958 | Berry | 434/278 |
| 2,992,829 | 7/1961 | Hopkins | 273/155 |
| 3,461,574 | 8/1969 | Larsen et al. | 273/156 X |
| 3,546,792 | 12/1970 | Sherman | 273/160 X |
| 3,565,442 | 2/1971 | Klein | 273/157 R |
| 3,645,535 | 2/1972 | Randolph | 273/157 R |
| 3,659,360 | 5/1972 | Zeischegg | 273/157 R X |
| 3,840,234 | 10/1974 | Felsten | 273/153 R X |
| 3,885,794 | 5/1975 | Coffin | 273/160 |
| 4,133,538 | 1/1979 | Ambrose | 273/157 R X |
| 4,153,254 | 5/1979 | Marc | 273/160 |
| 4,258,479 | 3/1981 | Roane | 434/211 |

FOREIGN PATENT DOCUMENTS

| | | | |
|---|---|---|---|
| 314,458 | 9/1919 | Fed. Rep. of Germany | 273/157 R |

*Primary Examiner*—Anton O. Oechsle

*Attorney, Agent, or Firm*—Stevens, Davis, Miller & Mosher

[57] ABSTRACT

The present invention relates to an amusement device which is formed of a plurality of differently shaped modular units which can interfit to form a solid equilateral tetrahedron. Each of the modular units is a single solid piece having a shape which is defined by the integral combination of one or more solid equilateral octrahedrons and one or more solid equilateral tetrahedrons. The modular units can also interfit to form random three-dimensional sculptural shapes.

29 Claims, 64 Drawing Figures

FIG. 1
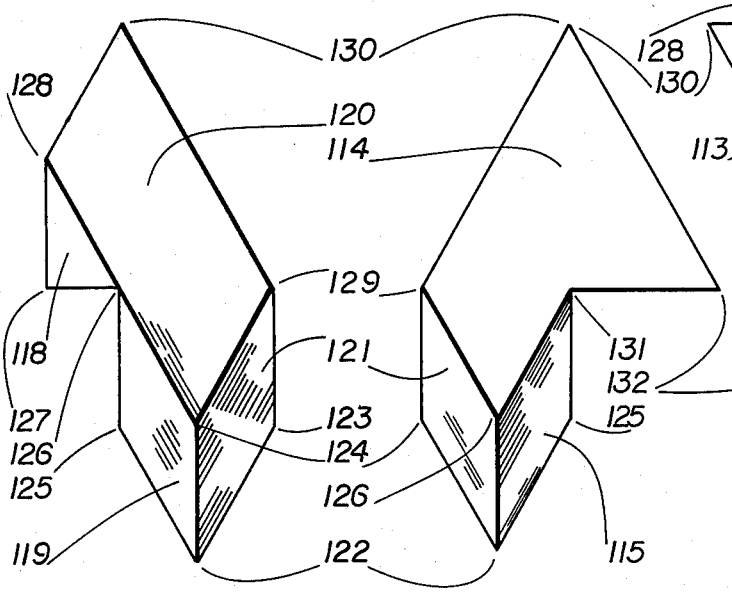
FIG. 2
FIG. 3
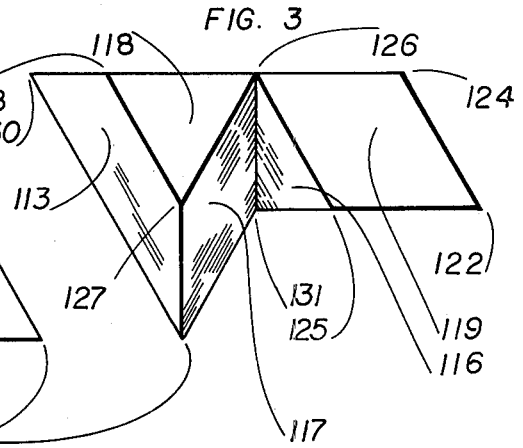
FIG. 4
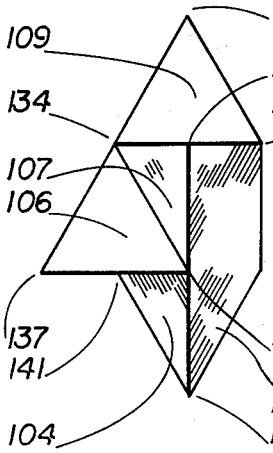
FIG. 5
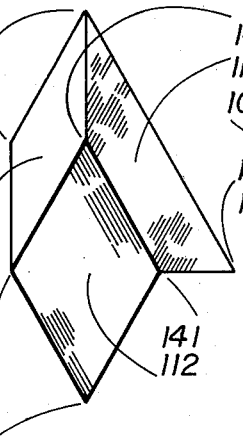
FIG. 6
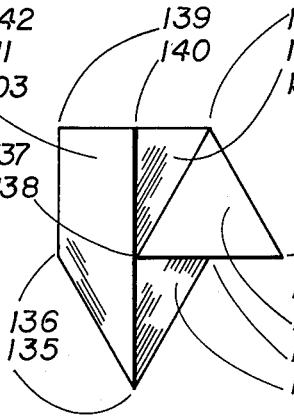
FIG. 7
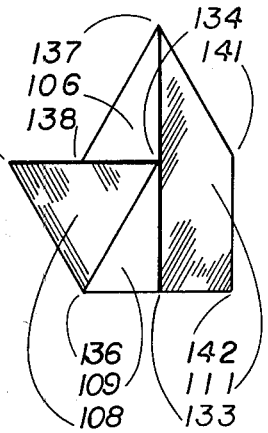
FIG. 8
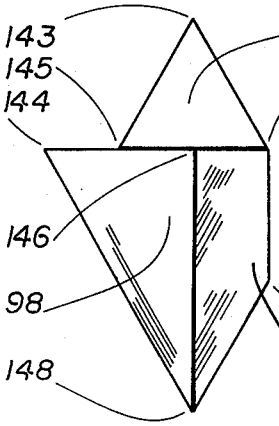
FIG. 9
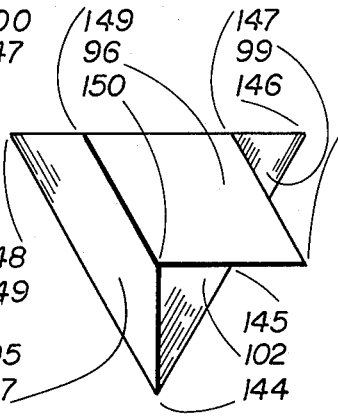
FIG. 10
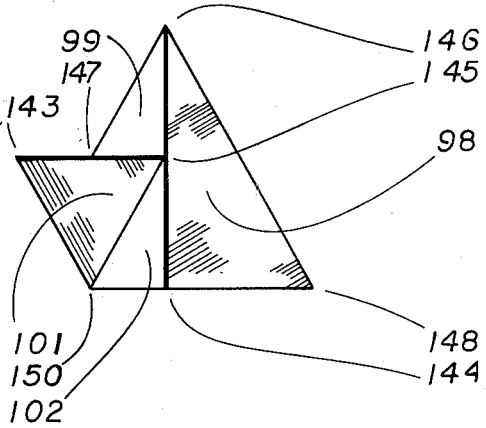

AMUSEMENT DEVICE FORMED OF A PLURALITY OF DIFFERENTLY SHAPED INTERFITTING MODULAR UNITS

BACKGROUND OF THE INVENTION

The present invention relates to an amusement device constructed of a plurality of individual modular units which can interfit to form a three-dimensional object.

Various amusement devices using this general concept have been devised over the years for recreational, educational and aptitude testing purposes. Very often, the amusement devices takes the form of a puzzle in which various pieces can be interfit to produce a specific object. Very often these puzzles and their associated pieces are of elementary design and are easily completed, so that once solved, the puzzle is no longer used.

The present invention seeks to provide an amusement device which can be used as a puzzle to form a solid equilateral tetrahedron which employs a plurality of interfitting solid modular units, each having a unique shape. Because each of the modular units has a unique shape, the difficulty of correctly fitting them together is increased significantly thus requiring considerable thought and trial and error to construct the tetrahedron. In addition, the shapes of each of the modular units is highly complex, being formed from the integral connection of one or more solid octrahedrons with one or more solid tetrahedrons, which further increases the degree of difficulty in assembling the units together to form the completed tetrahedron.

Thus, one object of the invention is to provide an amusement device in which a plurality of modular units, each having a unique and unusual shape, can be interfit to form a solid equilateral tetrahedron.

An additional object of the invention is to provide an amusement device in which a plurality of modular units, each having a unique and unusual shape, can also be interfit to form various three-dimensional shapes, thus allowing the amusement device to function as a free form sculpture.

An additional object of the invention is to provide an amusement device in which a plurality of modular units can be interfit to form a solid equilateral tetrahedron having a larger size, while a lesser number of the plurality of modular units can also be interfit to form a solid equilateral tetrahedron of smaller size.

Yet another object of the invention is to provide an amusement device in which each of the modular units has a unique and unusual geometric shape, which is defined by the integral connection of one or more solid octrahedrons and one or more solid tetrahedrons, at least one face of each tetrahedron being joined to an equal sized and shaped face of an octrahedron.

These and other objects and advantages of the invention will be more fully seen from the description below which is taken in accordance with the accompanying drawings in which:

FIG. 1 shows a first perspective view of a first modular unit (A) of the invention;

FIG. 2 shows a second perspective view of the first modular unit;

FIG. 3 shows a third perspective view of the first modular unit;

FIG. 4 shows perspective view of a second modular unit (B) of the invention;

FIG. 5 shows a second perspective view of the second modular unit;

FIG. 6 shows a third perspective view of the second modular unit;

FIG. 7 shows a fourth perspective view of the second modular unit;

FIG. 8 shows a first perspective view of a third modular unit (C) of the invention;

FIG. 9 shows a second perspective view of the third modular unit;

FIG. 10 shows a third perspective view of the third modular unit;

DETAILED DESCRIPTION OF THE INVENTION

The amusement device of the invention is formed of a plurality of interfitting modular units which can be used to construct a tetrahedron shape, preferably a solid equilateral tetrahedron. Each modular unit has a unique geometric shape which complicates the interfitting of the units to create the tetrahedron. Although a few of the modular units have a relatively simple shape, most have a highly complex geometry.

For purposes of illustrating the invention, but without limiting the same, two exemplary embodiments are described and illustrated, one using thirteen exemplary modular units and the other using seven exemplary modular units. The seven modular units of the second embodiment can be part of the thirteen modular units of the first embodiment. Thus, the thirteen modular units of the first embodiment can be used to construct a larger sized tetrahedron, while seven of the thirteen modular units can also be used to construct a smaller sized tetrahedron.

Each of the modular units of the two embodiments is formed by the integral combination of one or more octrahedrons with one or more tetrahedrons, the combination of octrahedrons and tetrahedrons and the locations of the octrahedrons relative to the tetrahedrons defining its geometric shape.

To facilitate subsequent discussion, the geometric characteristics of each of the exemplary modular units for the first embodiment of the invention can be summarized in Table I below. Table I lists the number of solid octrahedrons and solid tetrahedrons which are integrally connected to form each of the modular units (A–M), and further lists the number of planar faces, vertices and edges for each unit.

TABLE I

| MODULAR UNIT | A | B | C | D | E | F | G | H | I | J | K | L | M |
|---|---|---|---|---|---|---|---|---|---|---|---|---|---|
| OCTRAHEDRONS | 2 | 1 | 1 | 2 | 2 | 1 | 2 | 1 | 1 | 2 | 2 | 1 | 2 |
| TETRAHEDRONS | 4 | 4 | 4 | 4 | 4 | 2 | 4 | 3 | 3 | 3 | 2 | 3 | 5 |
| PLANAR FACES | 9 | 10 | 8 | 13 | 9 | 6 | 11 | 7 | 5 | 10 | 11 | 9 | 13 |
| VERTICES | 11 | 10 | 8 | 12 | 11 | 7 | 12 | 8 | 6 | 12 | 10 | 9 | 13 |
| EDGES | 16 | 15 | 12 | 19 | 13 | 11 | 19 | 11 | 9 | 19 | 18 | 14 | 20 |

As shown, each modular unit is formed of one or more octrahedrons and two or more tetrahedrons. However, the modular units can also be constructed with one or more tetrahedrons. The shapes of each of the modular units is different as indicated by the differing number of planar faces, vertices and edges for each piece. The planar faces of the tetrahedrons have the same size and shape as the planar faces of the octrahedrons and the planar faces of the tetrahedrons are in face to face contact with the planar faces of the octrahedrons in each unit. In those modular units containing two octrahedrons, the octrahedrons are joined along one common edge residing in an imaginary plane bisecting the octrahedrons into upper and lower pyramid shapes.

Figure 64:
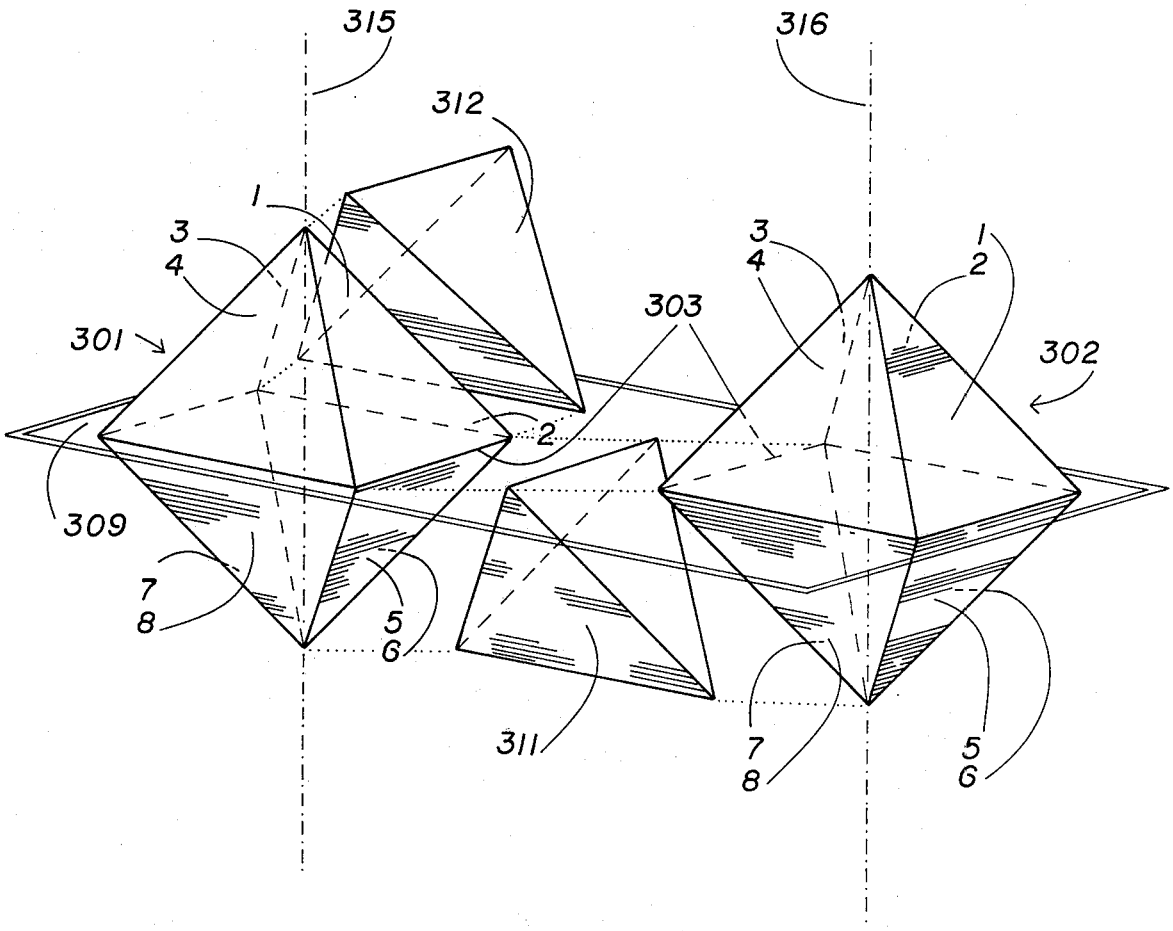
FIG. 64 shows the planar faces of the octrahedrons and tetrahedrons which are integrally joined to form the modular units of the invention.

For purposes of describing the specific combination of octrahedrons and tetrahedrons employed in each modular unit, reference will first be made to FIG. 64 which explains the notation used in the ensuing description. FIG. 64 illustrates first and second octrahedrons 301, 302 having respective central axes 315, 316 in parallel which can be joined along a common edge 303. As illustrated, each octrahedron has eight equilateral planar faces (1–8) which have arbitrarily been numbered in counterclockwise fashion. An imaginary plane 309 is shown as bisecting each of the octrahedrons 301, 302 into upper and lower pyramidal halves. Each of the upper four surfaces of each octrahedron has been arbitrarily numbered 1 through 4 starting from a rightmost edge of the octrahedron, while each of the bottom faces has been numbered in counterclockwise fashion from 5 through 8, again from the rightmost edge of the octrahedron. As seen in Table I above, some of the modular units contain only one octrahedron 301 while others contain two 301,302. Whenever two octrahedrons are employed, they are joined along common edge 303 leaving two negative spaces between faces 1 and 5 of the first octrahedron and faces 3 and 7 of the second octrahedron. For some modular units, one or both of these negative spaces may be filled with a tetrahedron.

The location of each of the tetrahedrons in the modular units can be specified by the octrahedron to which they are in coextensive face to face contact. For example, FIG. 64 shows by dotted lines a tetrahedron 312 joined to face 2 of the first octrahedron 301 and a tetrahedron 311 having one face joined to face 5 of the first octrahedron 301 and another face joined to face 7 of the second octrahedron 302. As shown, tetrahedron 311 fills the negative space between respective faces 5 and 7 of the first and second octrahedrons 301, 302. This notational convention will be used throughout the remainder of the specification and in the claims. However, it should be understood that other notations for specifying the locations of the tetrahedrons can also be adopted and the notation per se is not limiting of the invention.

Using the notation above, each of the modular units can now be uniquely defined by the planar faces of the octrahedron(s) to which tetrahedrons are integrally face-to-face connected. Table II defines the locations of the tetrahedrons and octrahedron(s) in each modular unit.

TABLE II

| MODULAR UNIT | NUMBER OF OCTRA-HE-DRONS | NUMBER OF TETRA-HE-DRONS | LOCATION OF TETRAHEDRONS ON OCTRAHEDRON(S) FACES ON OCTRA-HEDRON 1 | ON OCTRA-HEDRON 2 |
|---|---|---|---|---|
| A | 2 | 4 | 3 | 2 |
| | | | 5——— | ——7 |
| | | | | 5 |
| B | 1 | 4 | 1 | — |
| | | | 2 | — |
| | | | 3 | — |
| | | | 5 | — |
| C | 1 | 4 | 1 | — |
| | | | 2 | — |
| | | | 5 | — |
| | | | 7 | — |
| D | 2 | 4 | 1——— | ———3 |
| | | | | 1 |
| | | | | 2 |
| | | | | 8 |
| E | 2 | 4 | 4 | 2 |
| | | | 5——— | ———7 |
| | | | | 5 |
| F | 1 | 2 | 5 | — |
| | | | 7 | — |
| G | 2 | 4 | 1——— | ———3 |
| | | | 7 | 4 |
| | | | | 5 |
| H | 1 | 3 | 3 | — |
| | | | 5 | — |
| | | | 7 | — |
| I | 1 | 3 | 3 | — |
| | | | 6 | — |
| | | | 8 | — |
| J | 2 | 3 | 1——— | ———3 |
| | | | | 6 |
| K | 2 | 2 | 1——— | ———3 |
| | | | 3 | |
| L | 1 | 3 | 5 | — |
| | | | 6 | — |
| | | | 7 | — |
| M | 2 | 5 | 1——— | ———3 |
| | | | 5——— | ———7 |
| | | | | 6 |
| | | | | 2 |
| | | | | 8 |

The interconnecting line between the two octrahedrons in Table II denotes a single tetrahedron having two different faces respectively connected to a face of each octrahedron. Taking modular unit A as representative, Table II shows it is formed of two octrahedrons and four tetrahedrons. Two of the tetrahedrons are located on faces 3 and 5 of the first octrahedron (e.g. 301 in FIG. 64) while two other tetrahedrons are located on faces 2 and 5 of the second octrahedron (e.g. 302 in FIG. 64). Face 7 of the second octrahedron is also in face to face contact with the tetrahedron mounted to reference face 5 of the first octrahedron, and this is illustrated by the interconnecting segment shown between the two octrahedrons in Table II. Each of the remaining modular units have tetrahedrons mounted on the octrohedron faces as specified in Table II.

For purposes of further describing the overall exterior geometric shape of the modular units, reference will be made to FIGS. 1 through 41 which shows each of the modular units in different perspective views. Since the shapes of each of the involved modular units is often quite complex, the individual octrahedrons and tetrahedrons involved in each piece have not been illustrated to simplify the drawings. However, it should be appreciated that each of the units has octrahedrons and tetrahedrons arranged in the relationship identified above in Table II.

FIGS. 1 through 3 show three perspective views of modular unit A. This three-dimensional solid modular unit is formed of two octrahedrons and four tetrahedrons and has nine planar external surfaces surfaces 113 . . . 121 which converge at eleven vertices 122 . . . 132. The unit has sixteen edges where two planar surfaces converge as follows: (119-121), (119-120), (115-119), (116-119), (115-116), (115-121), (114-121), (115-114), (114-120), (114-117), (113-114), (113-117), (113-118), (117-118), (118-120), (113-120). A negative space is formed by the convergence of planar surfaces 116 and 117 at an interior corner.

Three of the tetrahedrons of modular unit A have apices at vertices 122, 130 and 132. The fourth tetrahedron fills a negative space between the two octrahedrons and has its four apices defined by vertices 131, 126, 129, 131 and the midpoint of the edge defined by convergence of planar surfaces 114 and 120. The central axes of the two octrhedrons pass respectively through vertices 125 and 129 and through vertex 127 and the midpoint of the edge defined by the convergence of planar surfaces 114 and 120.

FIGS. 4 through 7 show three perspective views of surfaces modular unit B which is constructed of one octrahedron and four tetrahedrons. This unit has ten planar 103 . . . 112 which converge at ten vertices 133 . . . 142. The unit has fifteen edges which are defined by the convergence of two planar surfaces as follows: (103-107), (103-104), (103-108), (103-110), (107-108), (109-111), (109-110), (106-111), (111-110), (111-105), (111-112), (112-103), (112-110), (104-112), (105-106). Three interior corners are defined by the intersection of planar surfaces (108-109), (106-107), (104-105). The four tetrahedrons have respective apices which can be identified in FIGS. 4 through 7 as vertices 133, 135, 137 and 140, and the axis of the octrahedron passes through vertices 138 and 142.

FIGS. 8 through 10 show three perspective views of modular unit C. This unit is formed of one octrahedron joined with four tetrahedrons to form eight planar faces 95 . . . 102 which converge at eight vertices 143 . . . 150. The piece has twelve edges which are defined where two planar surfaces converge as follows: (98-95), (98-99), (98-102), (98-97), (95-96), (95-97), (95-99), (96-100), (96-101), (96-97), (97-102), (100-101). Two interior corners are defined by the cnvergence of planar surfaces (99-100) and (101-102). The four solid tetrahedrons have apices respectively at vertices 148, 144, 143 and 146, while the central axis of the octrahedron passes through vertex 147 and the midpoint of the edge defined by the convergence of planar surfaces 97 and 98.

Figure 11:
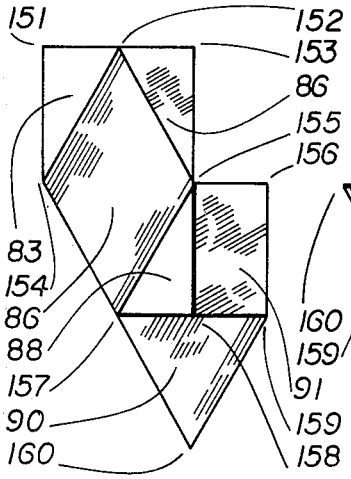
FIG. 11 shows a first perspective view of a fourth modular unit (D) of the invention.
Figure 12:
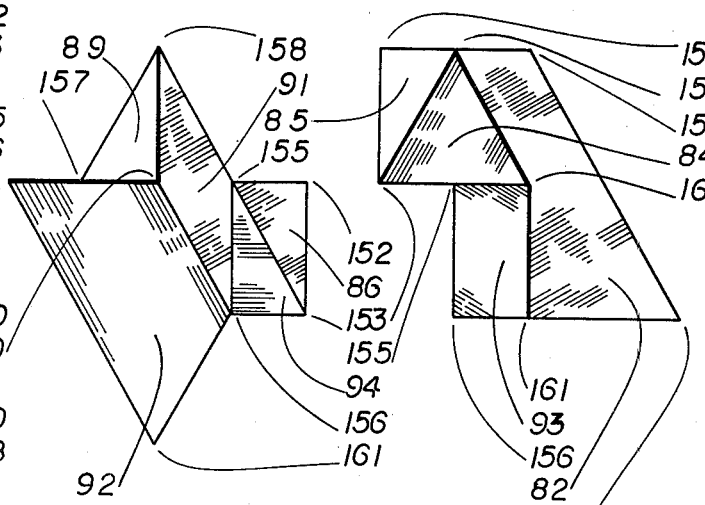
FIG. 12 shows a second perspective view of the fourth modular unit.
Figure 13:
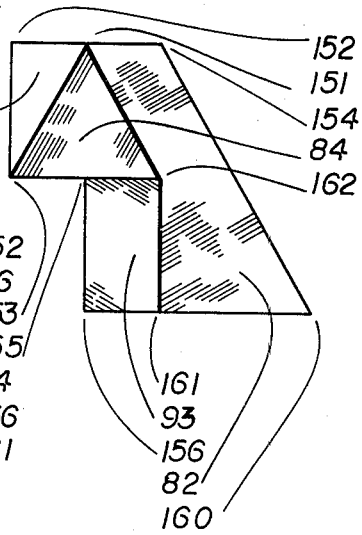
FIG. 13 shows a third perspective view of the fourth modular unit.

FIGS. 11 through 13 show three perspective views of modular unit D. This unit is formed of two octrahedrons joined with four tetrahedrons. The unit has thirteen planar surfaces 82 . . . 94 which converge at twelve vertices 151 . . . 162. This unit has nineteen edges which are defined where two planar surfaces converge as follows: (87-83), (87-86), (87-82), (83-82), (83-85), (88-91), (88-89), (89-91), (90-92), (90-82), (91-92), (91-93), (92-82), (93-82), (86-85), (86-94), (94-84), (84-82), (92-93). Three interior corners are defined by the convergence of planar surfaces (93-94), (87-88), and (89-90). Three of the solid tetrahedrons have their apices defined as respective vertices 158, 160 and 161, while the fourth tetrahedron is located in the negative space between two octrahedrons, having its apices defined as vertices 155, 154, 157 and 162. The central axis of the two octrahedrons respectively pass through vertices 154 and 153 and through vertices 157 and 156.

Figure 14:
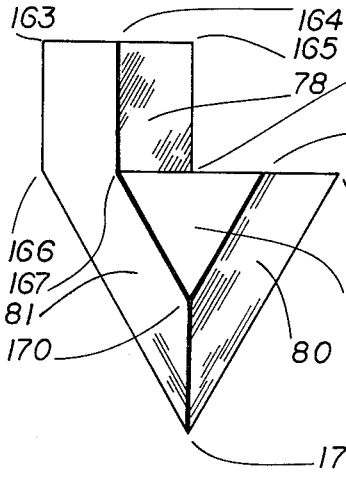
FIG. 14 shows first a perspective view of a fifth modular unit (E) of the invention.
Figure 15:
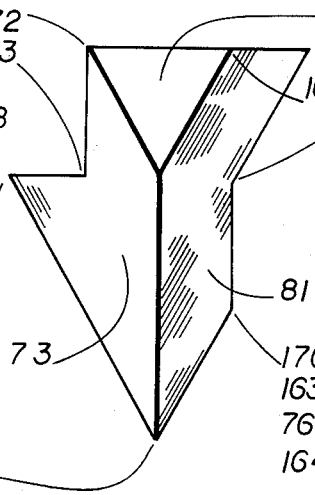
FIG. 15 shows a second perspective view of the fifth modular unit.
Figure 16:
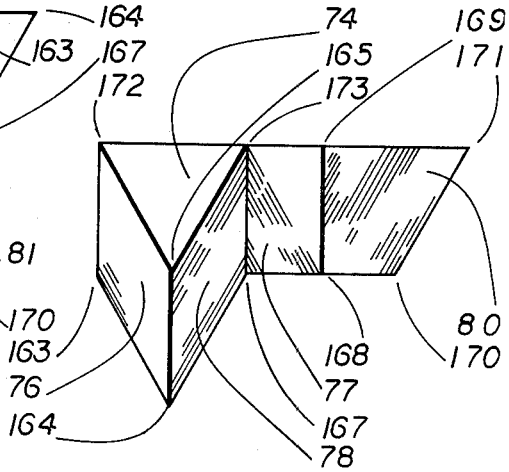
FIG. 16 shows a third perspective view of the fifth modular unit.

FIGS. 14 through 16 show three perspective views of modular unit E which is formed of two solid octrahedrons connected with four solid tetrahedrons. This unit has nine planar faces 73 . . . 81 which converge at eleven vertices 163 . . . 173. This unit also has seventeen edges which are defined where two planar surfaces converge as follows: (81-78), (81-80), (81-79), (79-80), (79-77), (80-77), (81-75), (81-76), (75-73), (81-73), (73-74), (73-77), (73-80), (74-78), (78-76), (74-76), (75-76). A negative space is also formed by the convergence of planar surfaces 77 and 78 at an interior corner. Three of the solid tetrahedrons have apices at respective vertices 164, 169 and 171, while the fourth tetrahedron is positioned between two octrahedrons having its four apices defined by vertices 166, 167, 173 and the midpoint of the edge defined by the convergence of planar surfaces 73 and 81. The central axis of the first octrahedron 1 passes through vertices 165 and 166, while the central axis of the second octrahedron passes through vertex 168 and at the midpoint of the edge defined by the convergence of planar surfaces 73 and 81.

Figure 17:
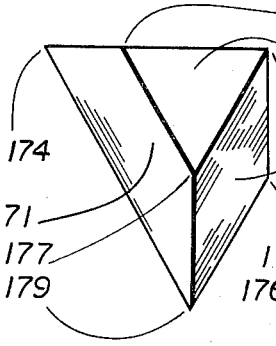
FIG. 17 shows a first perspective view of a sixth modular unit (F) of the invention.
Figure 18:
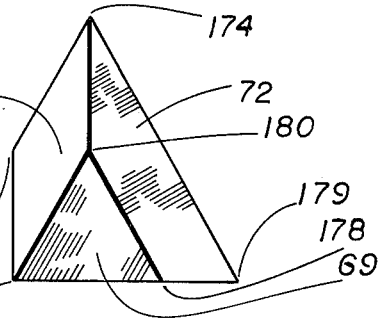
FIG. 18 shows a second perspective view of the sixth modular unit.

FIGS. 17 and 18 shows two perspective views of modular unit F which is formed of one solid octrahedron joined with two solid tetrahedrons. Six planar faces 67 . . . 72 are provided which converge at seven vertices 174 . . . 180. This unit has eleven edges which are defined by the intersection of two planar surfaces as follows: (68-71), (68-67), (68-70), (71-67), (71-72), (71-70), (70-72), (70-69), (69-72), (67-72), (67-69). The apices of the two solid tetrahedrons are at respective vertices 174 and 179, while the central axis of the solid tetrahedron passes through vertex 176 and the midpoint of the edge defined by convenging surfaces 71 and 72.

Figure 19:
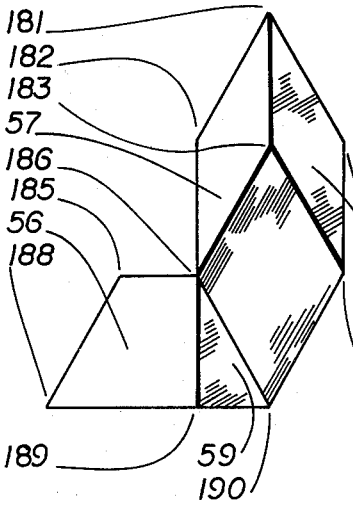
FIG. 19 shows a first perspective view of a seventh modular unit (G) of the invention.
Figure 20:
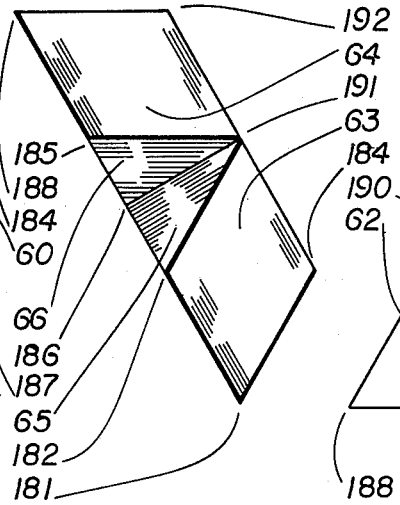
FIG. 20 shows a second perspective view of the seventh modular unit.
Figure 21:
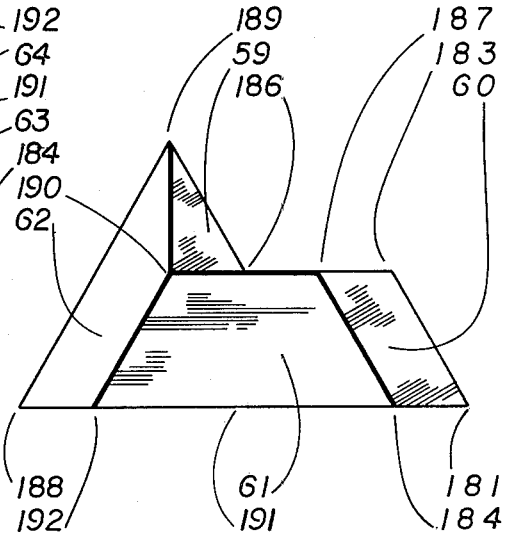
FIG. 21 shows a third perspective view of the seventh modular unit.

FIGS. 19 through 21 show three perspective views of modular unit G which is formed of two octrahedrons and four tetrahedrons. This unit has eleven planar faces 56 . . . 66 which converge at twelve vertices 181 . . . 192. Nineteen edges are defined by the convengence of two planar surfaces as follows: (57-60), (57-58), (60-58), (58-61), (59-62), (56-59), (56-66), (56-62), (64-56), (66-64), (62-64), (64-61), (61-63), (61-60), (60-63), (63-57), (63-65), (65-57), (62-61). Two interior corners are defined by the convergence of planar surfaces (65-66) and (58-59). Three of the solid tetrahedrons have respective apices at vertices 181, 188 and 189. The fourth solid tetrahedron is located between two octrahedrons and its four apices are respectively defined at the vertices 186, 187, 191 and 190. The central axis of the octrahedron passes through vertices 182 and 187, while the central axis of the second octrahedron passes through vertices 185 and 190.

Figure 22:
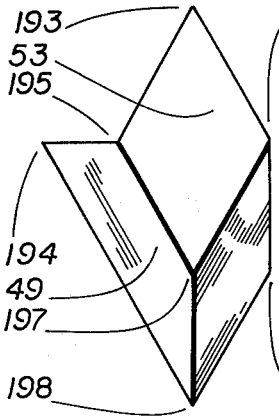
FIG. 22 shows a first perspective view of an eighth modular unit (H) of the invention.
Figure 23:
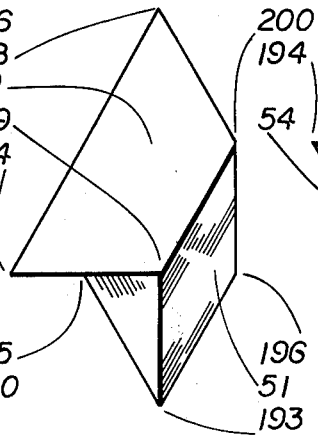
FIG. 23 shows a second perspective view of the eighth modular unit.
Figure 24:
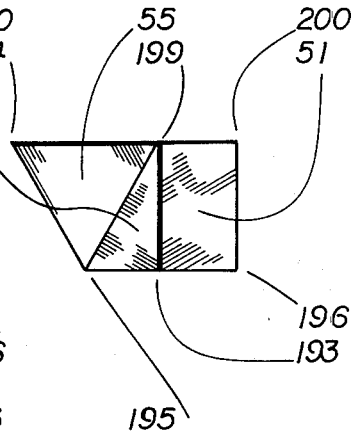
FIG. 24 shows a third perspective view of the eighth modular unit.

FIGS. 22 through 24 show three perspective views of modular unit H which is formed of one solid octrahedron joined with three solid tetrahedrons. This unit has seven planar surfaces 49 . . . 55 which converge at eight vertices 193 . . . 200. Twelve edges are defined by the intersection of two planar surfaces as follows: (53-52), (49-53), (49-52), (53-51), (53-54), (49-55), (49-50), (55-50), (51-50), (50-52), (51-52), (51-54). One interior corner is defined by the convergence of planar surfaces 54 and 55. The three solid tetrahedrons have respective apices located at vertices 193, 194 and 198, while the octrahedron has a central axis which passes through vertex 196 and the midpoint of the edge formed by the convengence of planar surfaces 49 and 50.

Figure 25:
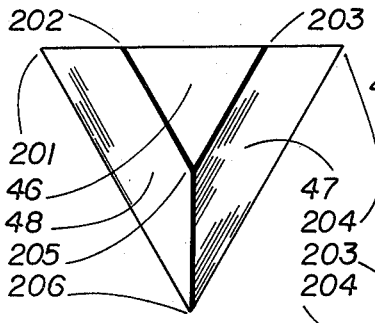
FIG. 25 shows a first perspective view of a ninth modular unit (I) of the invention.
Figure 26:
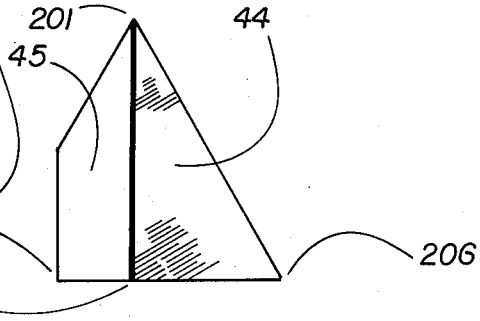
FIG. 26 shows a second perspective view of the ninth modular unit.
Figure 27:
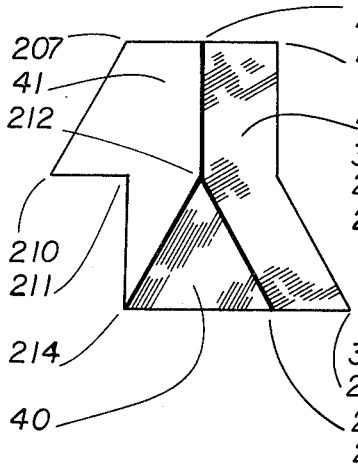
FIG. 27 shows a first perspective view of a tenth modular unit (J) of the invention.
Figure 28:
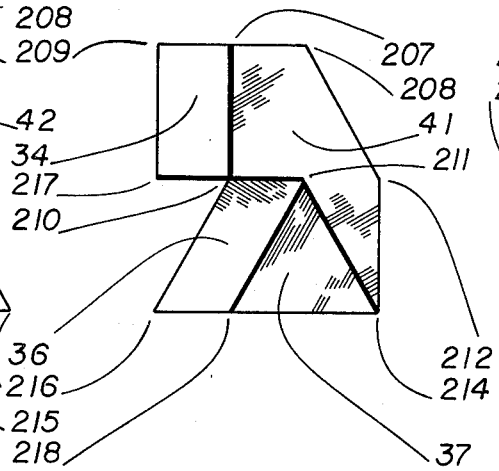
FIG. 28 shows a second perspective view of the tenth modular unit.
Figure 29:
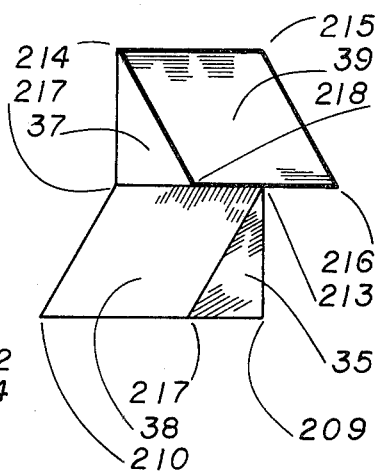
FIG. 29 shows a third perspective view of the tenth modular unit.
Figure 30:
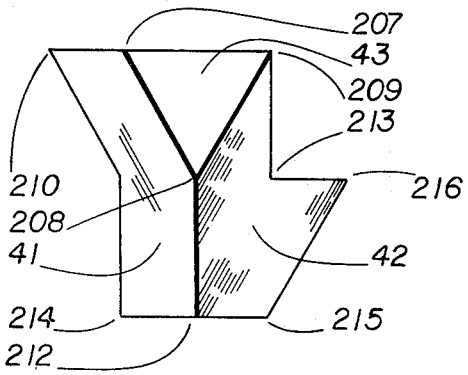
FIG. 30 shows a fourth perspective view of the tenth modular unit.
Figure 31:
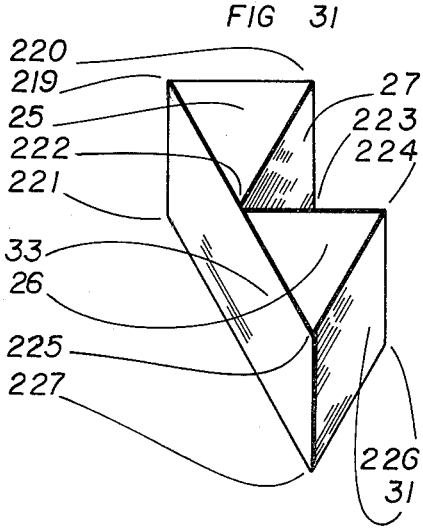
FIG. 31 shows a first perspective view of an eleventh modular unit (K) of the invention.
Figure 32:
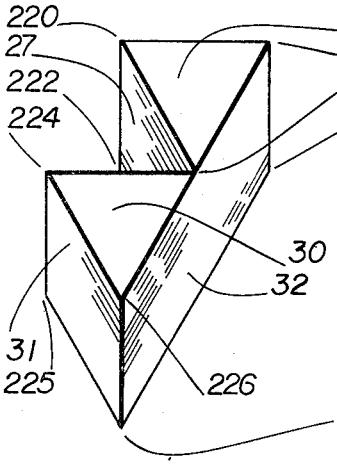
FIG. 32 shows a second perspective view of the eleventh modular unit.
Figure 33:
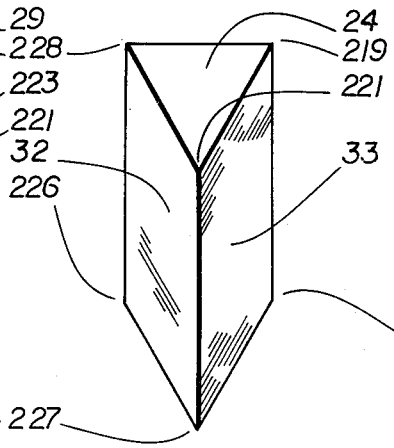
FIG. 33 shows a third perspective view of the eleventh modular unit.
Figure 34:
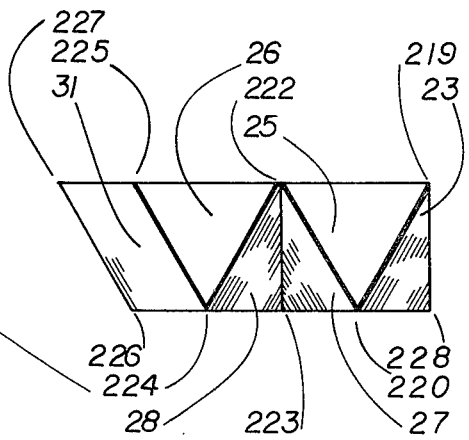
FIG. 34 shows a fourth perspective view of the eleventh modular unit.

FIGS. 25 and 26 show two perspective views of modular unit I which is formed of one solid octrahedron and three solid tetrahedrons. This unit has five planar surfaces 44 . . . 48 which converge at six vertices 201 . . . 206. Nine edges are defined by the intersection of two planar surfaces as follows: (46-47), (46-45), (46-48), (47-45), (47-44), (47-48), (44-45), (44-48), (45-48). The three solid tetrahedrons have respective apices at vertices 201, 204 and 206 while the central axis of the octrahedron passes through vertex 205 and the midpoint of the edge defined by the convengence of planar surfaces 44 and 45.

FIGS. 27 through 30 show four perspective views of modular unit J which is formed of two solid octrahedrons connected with three solid tetrahedrons. This unit has ten planar faces 34 . . . 43 which converge at twelve vertices 207 . . . 218. This unit has nineteen edges which are defined by the convergence of two planar surfaces as follows: (41-42), (41-43), (41-40), (40-42), (42-43), (40-39), (39-42), (42-36), (42-35), (35-38), (35-34), (34-43), (38-34), (39-36), (37-39), (36-37), (37-41), (41-38), (34-41). One interior corner is defined by the convergence of planar surfaces 36 and 38. Two of the solid tetrahedrons have apices respectively located at vertices 216 and 210 while the third solid tetrahedron is located between two octrahedrons and has four apices at vertices 208, 211, 212 and 213. The two octrahedrons respectively have central axes which pass through vertices 212 and 218 and through vertices 208 and 227.

FIGS. 31 through 34 show four perspective views of modular unit K which is constructed of two solid octrahedrons and two solid tetrahedrons. This unit has eleven planar faces 23 . . . 33 which converge at ten vertices 207 . . . 218. Eighteen edges are defined by the convergence of two planar surfaces as follows: (26-33), (26-31), (26-28), (25-27), (25-23), (25-33), (33-24), (33-31), (31-30), (28-30), (30-32), (29-32), (24-32), (32-33), (32-31), (23-24), (23-29), (29-27). One interior corner is defined by the convergence of planar surfaces 27 and 28. The apex of one of the solid tetrahedrons is at vertex 227 while the other solid tetrahedron is located between the two octrahedrons having its four apices at respective vertices 221, 222, 223 and at the midpoint of the edge defined by the intersection of planar surfaces 32 and 33. The central axes of the two octrahedrons respectively pass through vertex 224 and the midpoint of the edge defined by the convergence of planar surfaces 32 and 33, and through the vertices 220 and 221.

Figure 35:
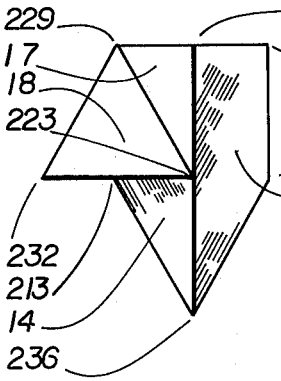
FIG. 35 shows a first perspective view of a twelfth modular unit (L) of the invention.
Figure 36:
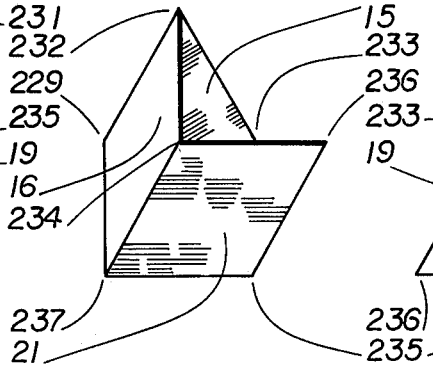
FIG. 36 shows a second perspective view of the twelfth modular unit.
Figure 37:
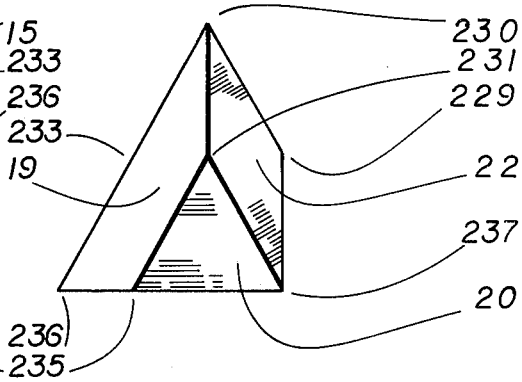
FIG. 37 shows a third perspective view of the twelfth modular unit.
Figure 38:
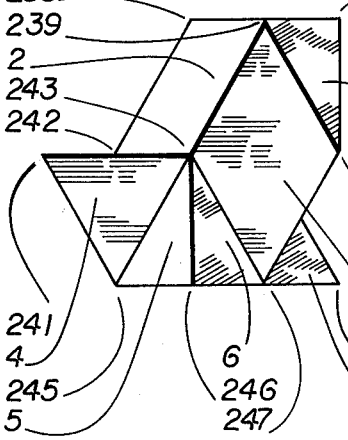
FIG. 38 shows a first perspective view of a thirteenth modular unit (M) of the invention.
Figure 39:
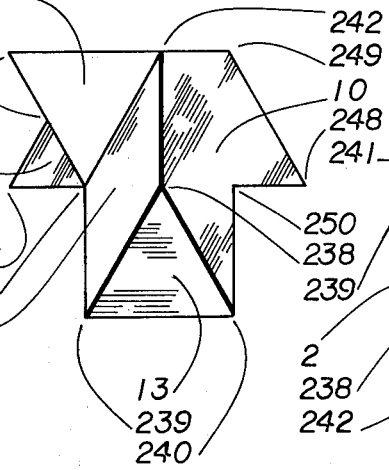
FIG. 39 shows a second perspective view of the thirteenth modular unit.
Figure 40:
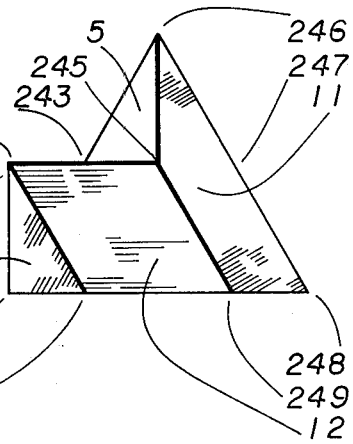
FIG. 40 shows a third perspective view of the thirteenth modular unit.
Figure 41:
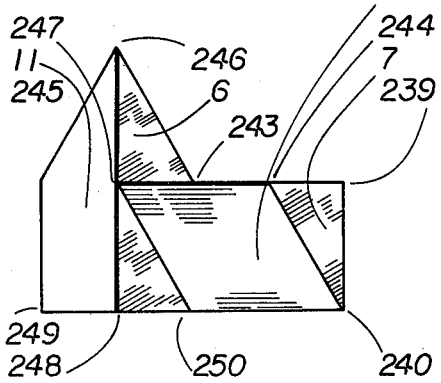
FIG. 41 shows a fourth perspective view of the thirteenth modular unit.

FIGS. 35 through 37 show three perspective views of modular unit L which is formed of one solid octrahedron connected with three solid tetrahedrons. This unit has nine planar faces 14 . . . 22 and at nine vertices 229 . . . 237. Fourteen edges are defined by the convergence of two planar surfaces as follows: (17-19), (17-22), (14-19), (18-15), (18-16), (15-16), (14-21), (19-21), (19-20), (19-22), (20-22), (20-21), (16-21), (16-22). Two internal corners are defined by the convergence of planar surfaces (14-15) and (17-18). Three of the solid tetrahedrons have apices respectively located at vertices 230, 232 and 236, while the solid octrahedron has a central axis which passes through vertices 233 and 237.

FIGS. 38 through 41 show four perspective views of modular unit M which is formed of two solid octrahedrons and five solid tetrahedrons. This unit has thirteen planar faces 1 . . . 13 which converge at thirteen vertices 238 . . . 250. Twenty edges are defined by the convergence of two planar surfaces as follows: (1-7), (1-2), (1-8), (7-13), (2-13), (13-10), (2-10), (5-6), (6-11), (5-11), (11-12), (10-11), (7-8), (8-10), (12-10), (4-12), (3-12), (3-4), (9-11), (9-10). Four interior corners are defined by the convergence of planar surfaces (8-9), (1-6), (4-5), and (2-3). Three of the solid tetrahedrons have apices respectively located at vertices 241, 246 and 248, while the remaining two solid tetrahedrons are located between the two octrahedrons. Of the two remaining tetrahedrons, one has its four apices located at vertices 243, 244, 247 and 250, while the other has its four apices located at vertices 238, 242, 242 and 250. The central axes of the two octrahedrons respectively pass through vertices 244 and 238 and through vertices 242 and 247.

The modular units constructed as described can be fit together to form a solid equilateral tetrahedron, or can be used to construct a free form sculpture. The manner in which these units interfit to form a solid equilateral tetrahedron will now be described. Although the description is of one sequence of asembly steps to construct an equilateral tetrahedron from the individual modular units, it should be appreciated that the tetrahedron can also be constructed with a different sequence of steps. Stated otherwise, the following description is merely exemplary of one method, but not the only method, of constructing a solid tetrahedron using the component modular units.

Figure 42:
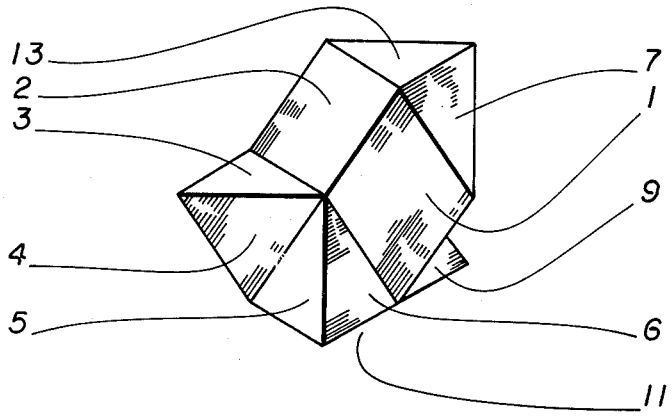
FIG. 42 through 54 show in perspective view the step-by-step sequence for constructing a larger sized solid tetrahedron using the first through thirteenth modular units illustrated in FIGS. 1 through 41.
Figure 43:
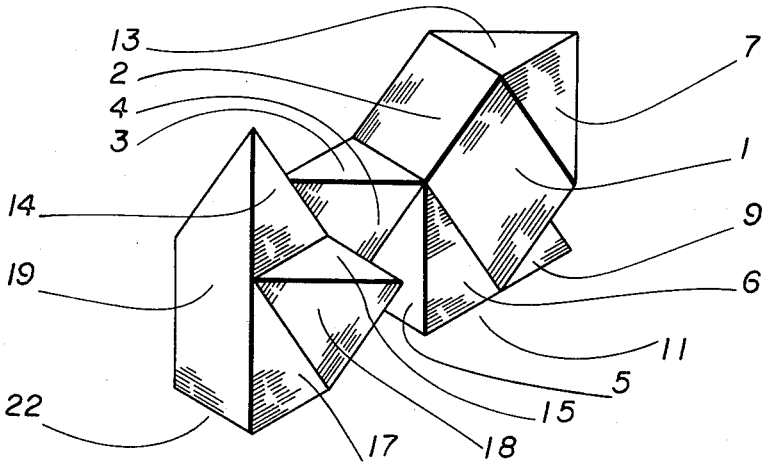

FIG. 42 shows modular unit M resting on a base formed of planar surface 11. FIG. 43 shows the placement of modular unit L adjacent to and in contact with modular unit M. Modular unit L rests on planar surface 22 which acts as its base. Modular units L and M are pushed together such that planar surface 21 of modular unit L abuts with planar surface 4 of modular unit M, i.e., L 21-M 4, and planar surface 16 of modular unit L abuts with planar surface 5 of modular unit M, i.e., L 16-M 5.

Figure 44:
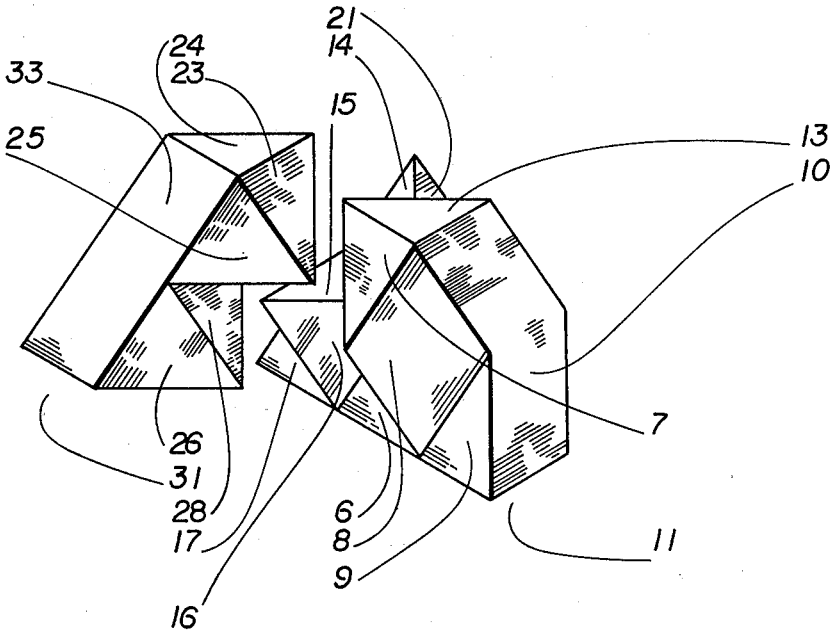

FIG. 44 shows the placement of modular unit K into abutment with modular units L and M. Modular unit K rests on planar surface 31 which forms its base and abuts with the planar surfaces of modular unit L as follows: K 29-L 14; K 27-L 15; K 28-L 18; and K 30-L 17.

Figure 45:
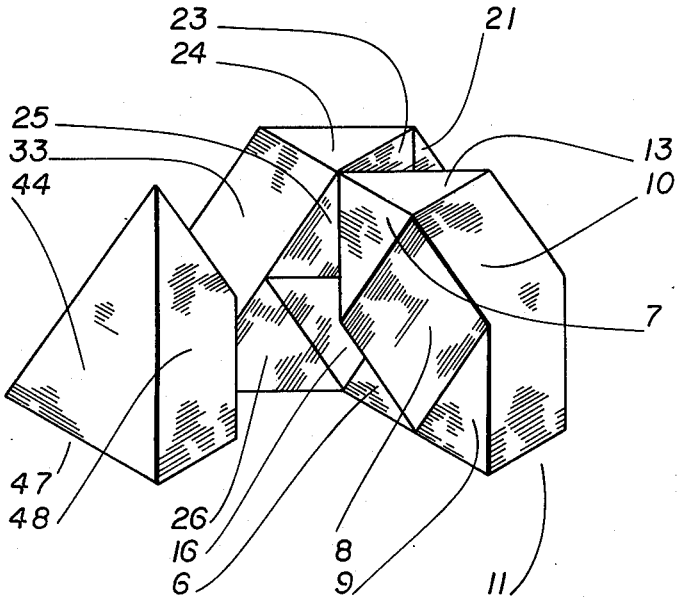

FIG. 45 shows the addition of modular unit I to the assembly. Modular unit I rest on surface 47 which forms its base and abuts with units K, M and L as follows: I 45-K 25, K 26, L 16; I 46-M 6; and I 48-M 1.

Figure 46:
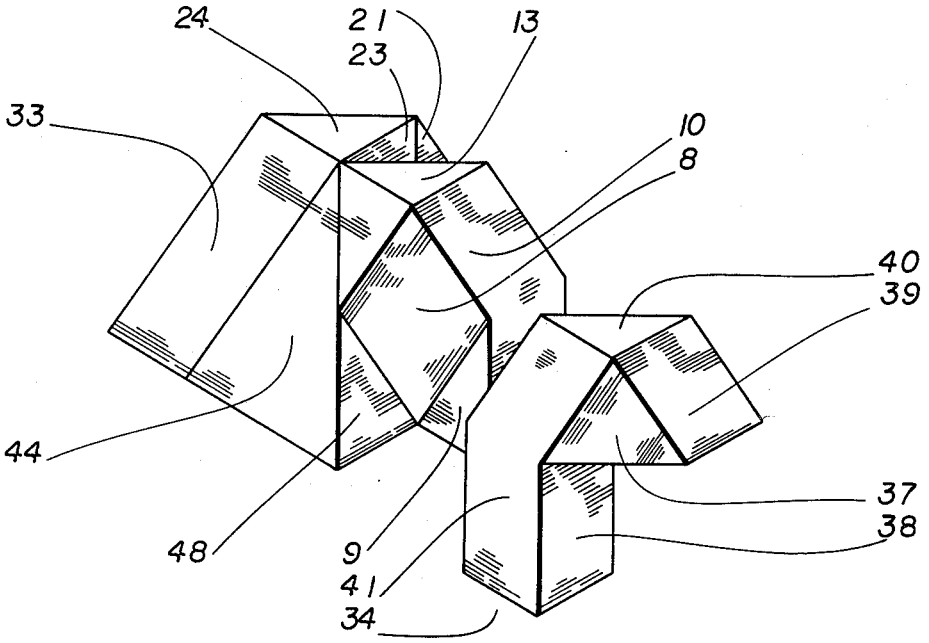

FIG. 46 shows the addition of modular unit J to the assembly. It rests on surface 34 which forms its base. Modular unit J has its surfaces abutted to those of units I and M as follows: J 43-I 48; J 42-M 8; and J 35-M 9.

Figure 47:
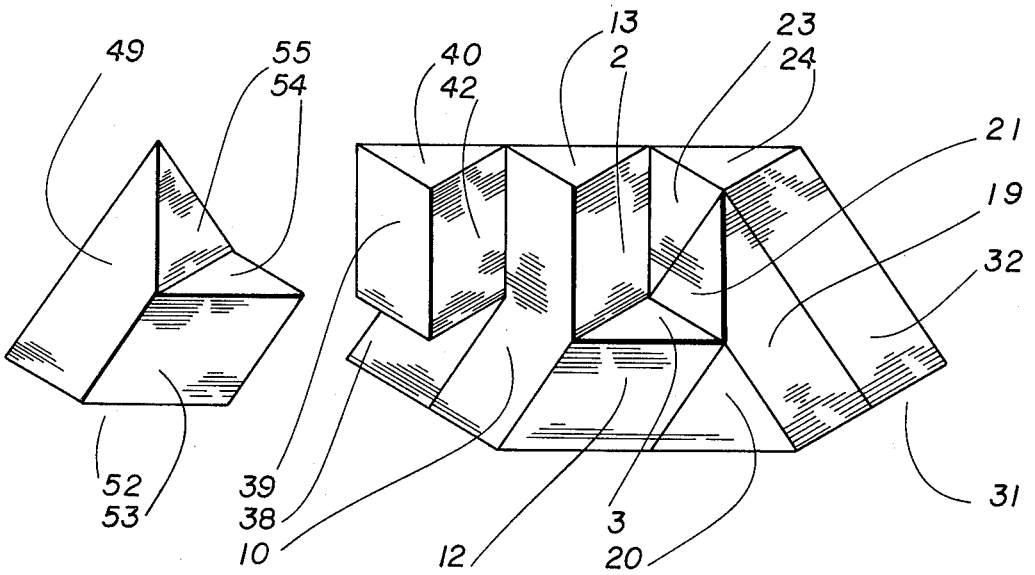

FIG. 47 shows the addition of modular unit H to the assembly. It rests on surface 52 which forms its base. The planar surfaces of unit H engage with those of unit J as follows: H 55-J 37; H 54-J 36; and H 51-J 38.

Figure 48:
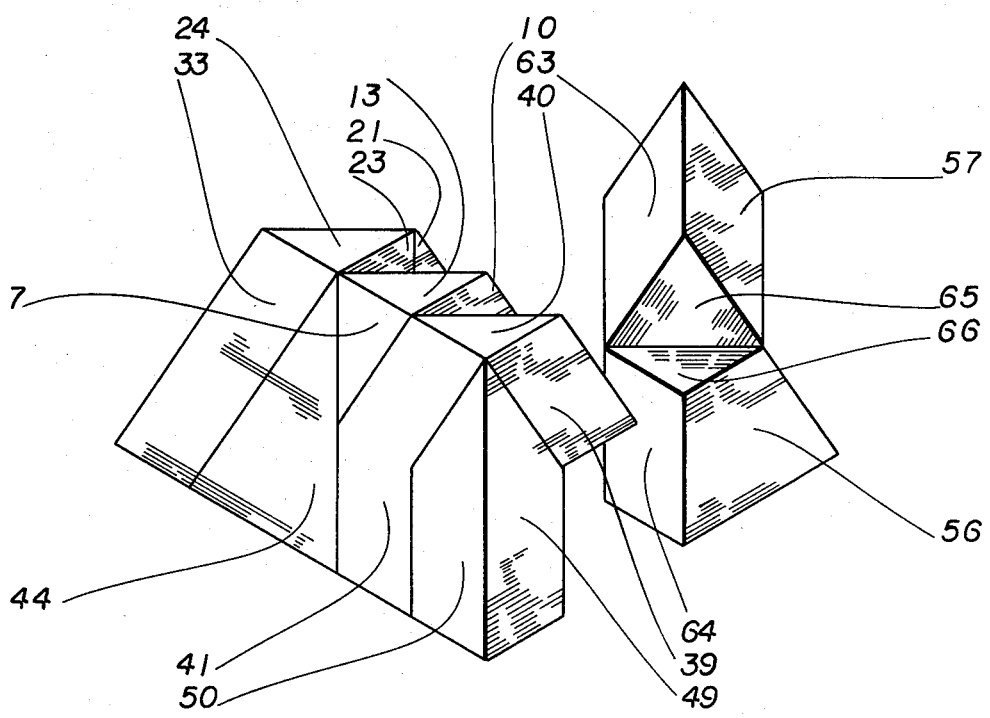

FIG. 48 shows the addition of modular unit G to the assembly. It rests on planar surface 62 forming its base. The planar surfaces of this unit abut with the planar surfaces of the other units as follows: G 64-H 53; G 66-J 36; G 61-M 10; and G 65-I 42.

Figure 49:
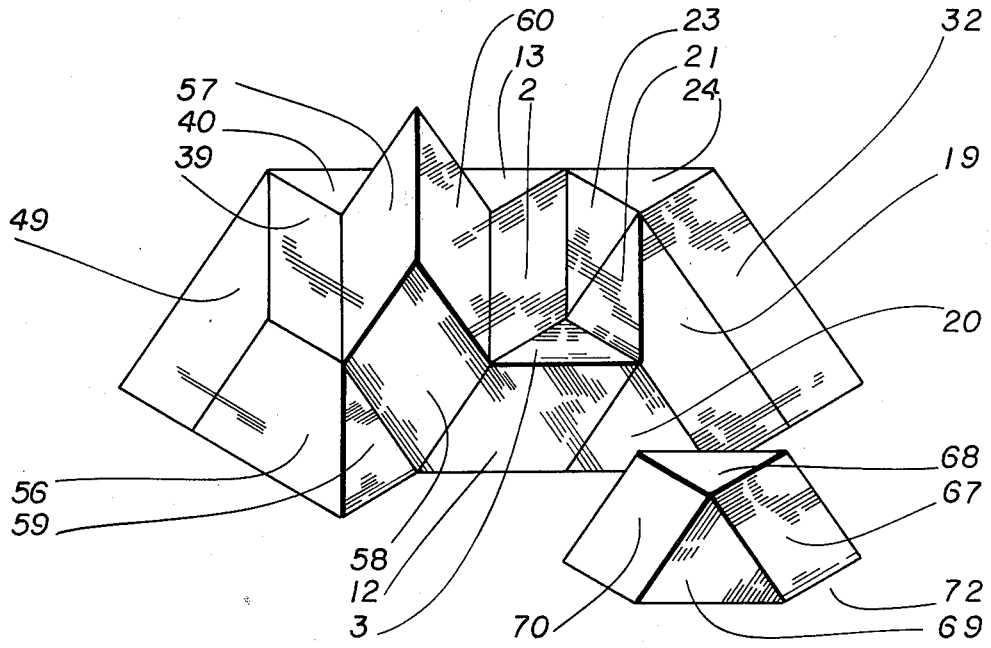

FIG. 49 shows the addition of modular unit F to the assembly. It rests on surface 72 forming its base. It abuts with units L and M as follows: F 71-L 20, M 12.

Figure 50:
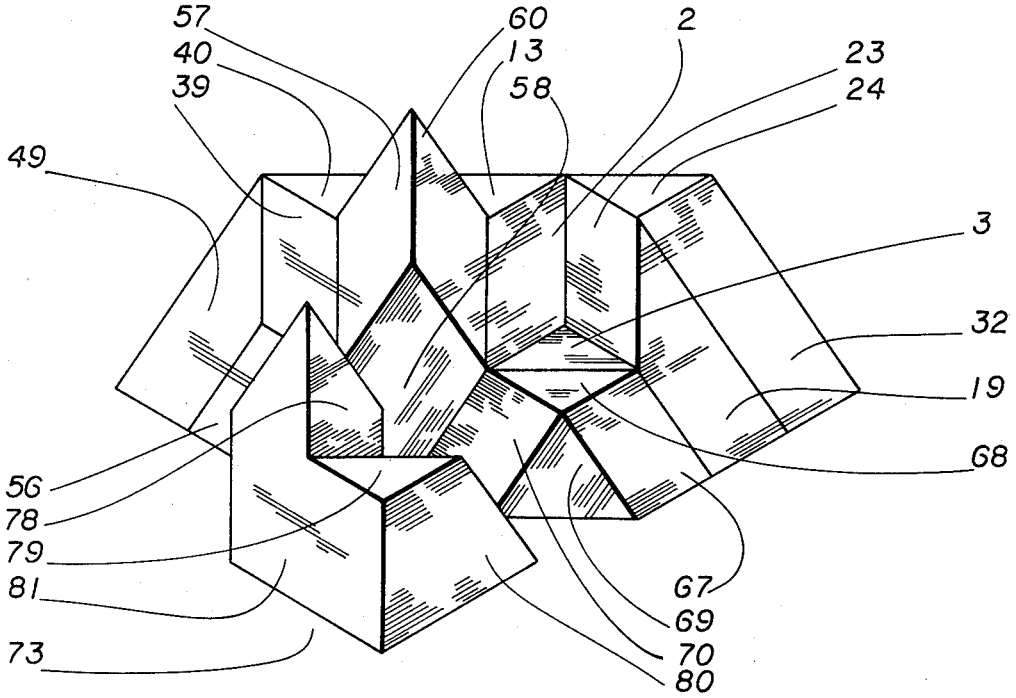

FIG. 50 shows the addition of modular unit E to the assembly. Unit E rests on surface 73 which forms its base and abuts with the remaining units as follows: E 75-G 59; E 76-G 58; E 74-F 70; and E 77-F 69.

Figure 51:
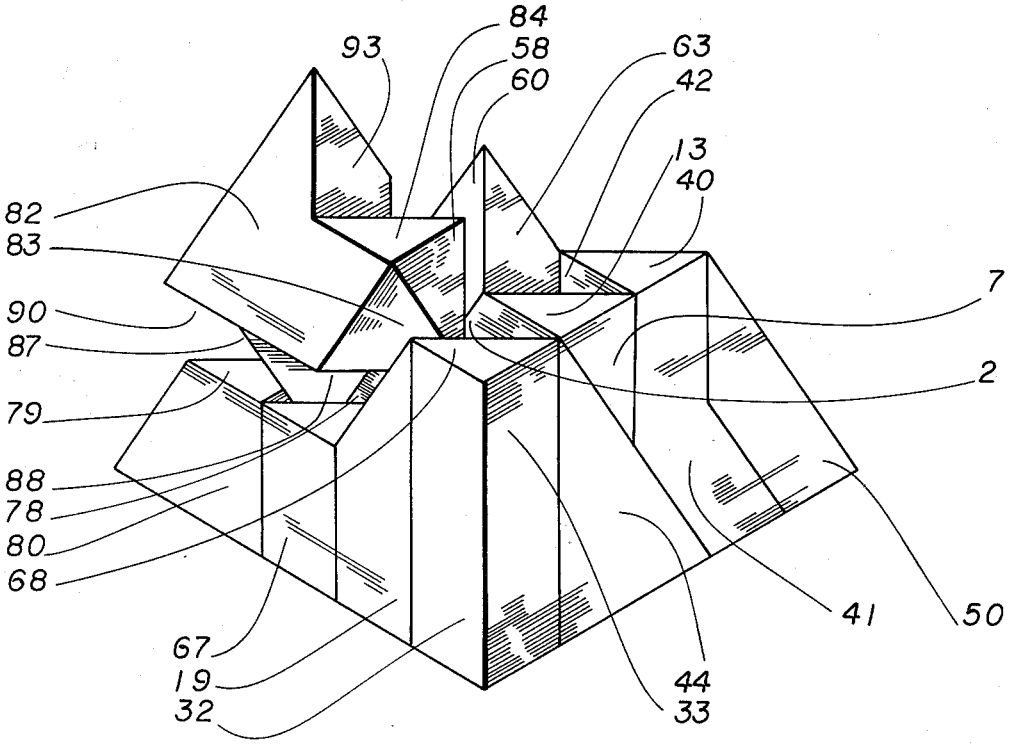

FIG. 51 shows the addition of modular unit D to the assembly. This unit rests on surfaces 90 and 87 which form its base and these surfaces respectively rest on surfaces E 79 and F 68. The remaining surfaces of modular unit D abut with surfaces of the other modular units as follows: D 89-E 77; D 88-F 70; D 91-E 78; D 86-M 2; and D 83-L 21.

Figure 52:
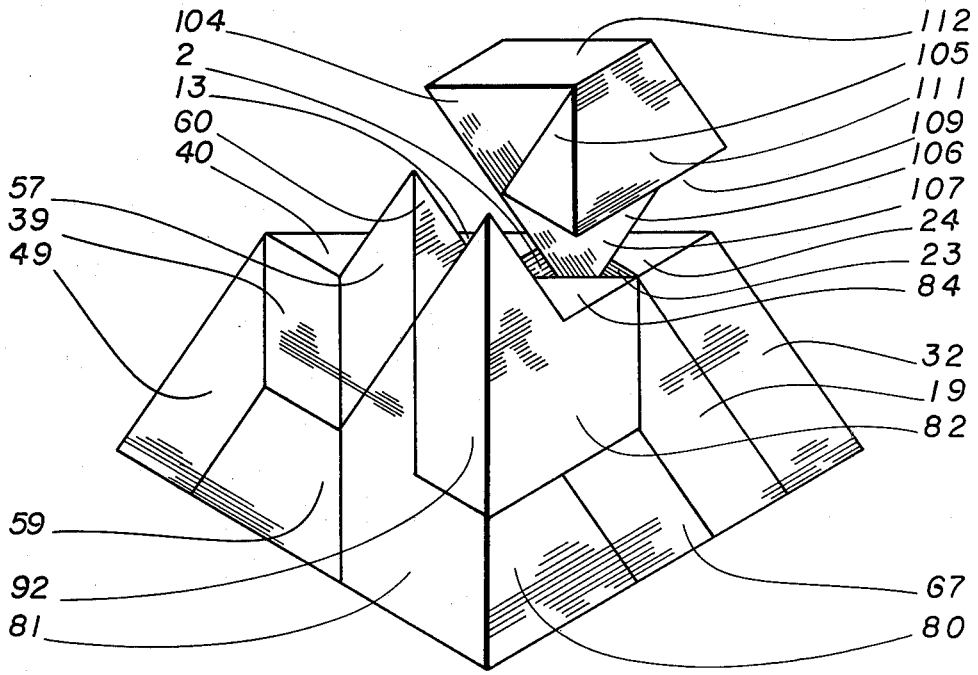

FIG. 52 shows the addition of modular unit B to the assembly. It rest on surfaces 109 and 106 forming a base which surfaces in turn respectively rest on surfaces 24 of unit K and 84 of unit D. The remaining planar surfaces of unit B abut with surfaces of the other modular units as follows: B 108-K 23; B 107-D 85; and B 103-M 2.

Figure 53:
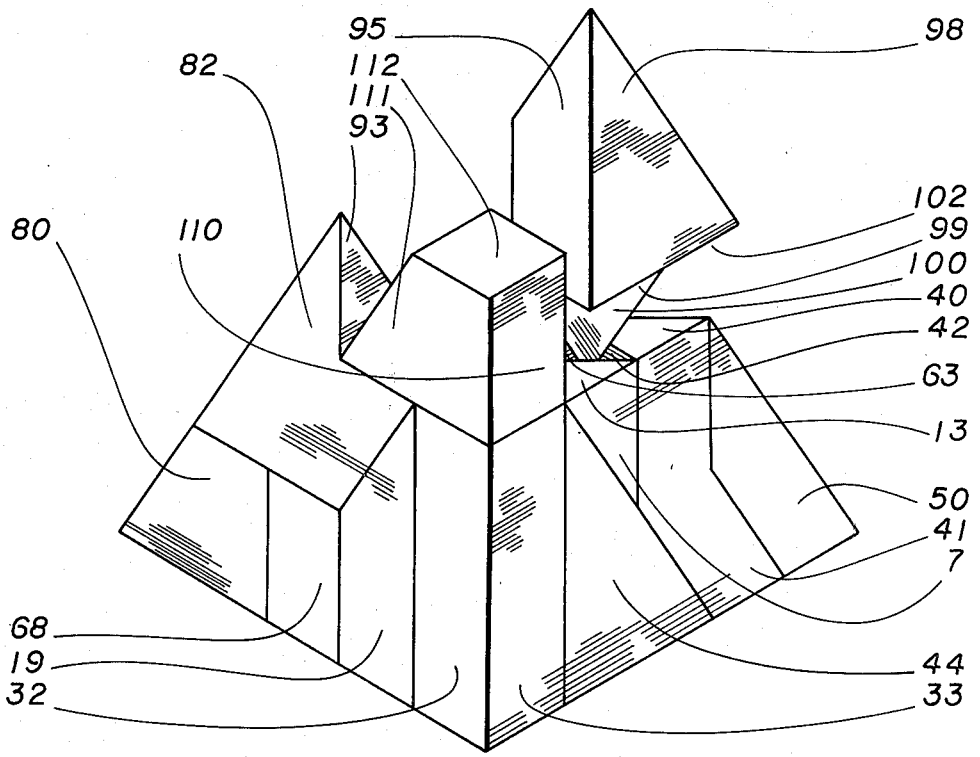

FIG. 53 shows the addition of modular unit C to the assembly. It rests on surfaces 102 and 99 forming its base. Surfaces 102 and 99 are respectively supported on surface 40 of unit J and surface 13 of unit M. The remainder of the planar surfaces of unit C abut surfaces of the other modular units as follows: C 101-J 42; C 100-M 10; and C 96-G 63.

Figure 54:
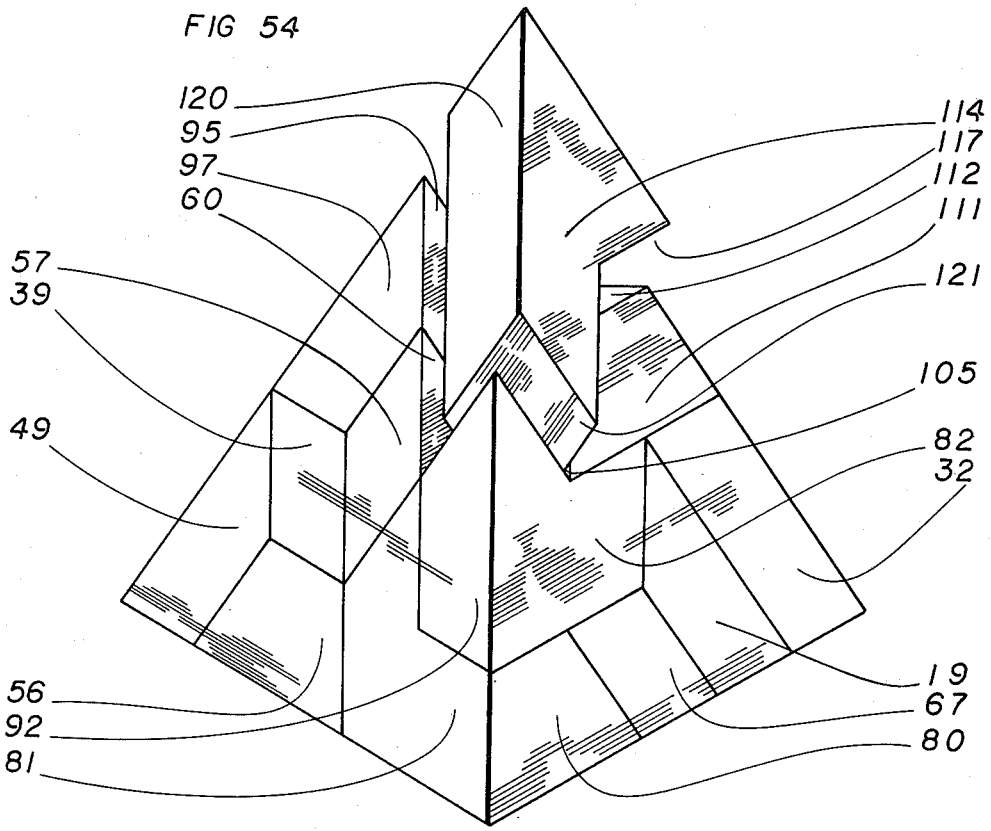
Figure 55:
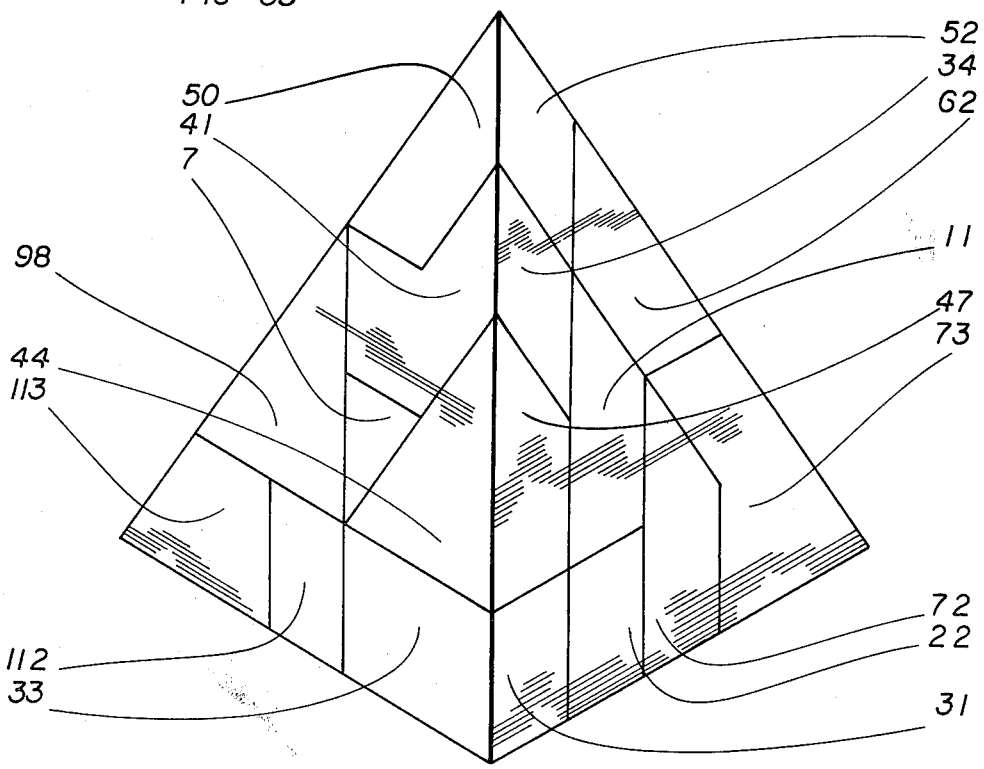
FIG. 55 shows another perspective view of the completed tetrahedron shown in FIG. 54.

FIG. 54 shows the addition of the last modular unit A to the assembly. It rests on planar surface 117 which is supported on planar surface 112 of modular unit B. The remaining surfaces of modular unit A abut with surfaces of the other modular units as follows: A 121-D 93; A 115-B 105, D 94; A 116-B 104; A 119-G 60; A 19-G 60; and A 118-C 95. Another view of the completed tetrahedron is shown in FIG. 55.

As described earlier, seven of the modular units of the first embodiment can also be fit together to form a smaller solid tetrahedron in a second embodiment of the invention as described below. Again, although one exemplary construction sequence is described, other construction sequences can also be used. The modular units used to form the smaller tetrahedron are H, G, J, C, L, E, and I.

Figure 56:
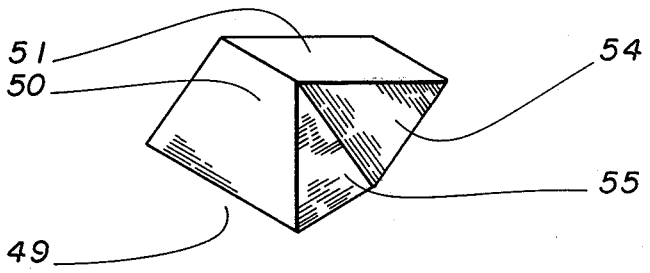
FIGS. 56 through 62 show in perspective view the step-by-step sequence for constructing a smaller solid tetrahedron using selected ones of the thirteen modular units illustrated in FIGS. 1 through 41.
Figure 57:
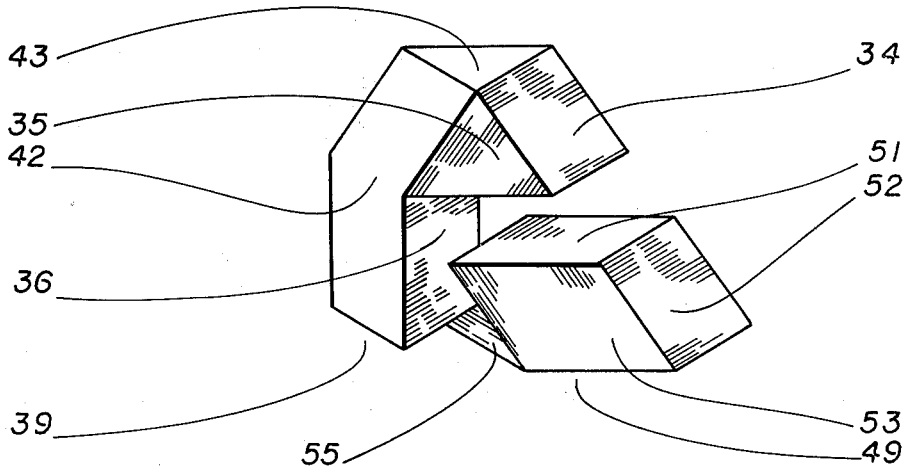

FIG. 56 shows unit H resting on surface 49 which forms its base. To this is added modular unit J, as shown in FIG. 57 with the surfaces of the two pieces mating as follows: H 54-J 36 and H 55-J 37.

Figure 58:
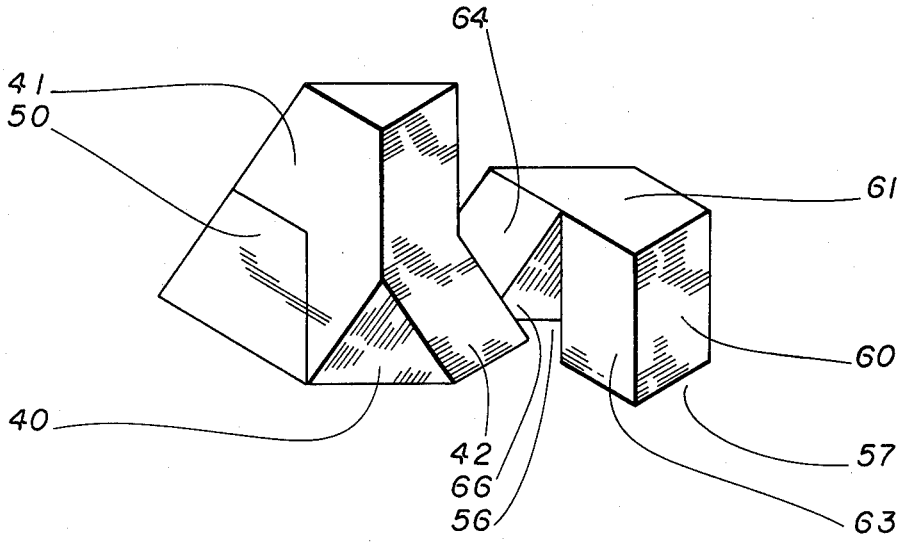

FIG. 58 shows the addition of modular unit G to the assembly of FIG. 57. Modular unit G rests on planar surface 57 which forms its base and the remaining surfaces of unit G abut with surfaces of J and H as follows: G 65-J 42; G 66-J 36; and G 64-H 53.

Figure 59:
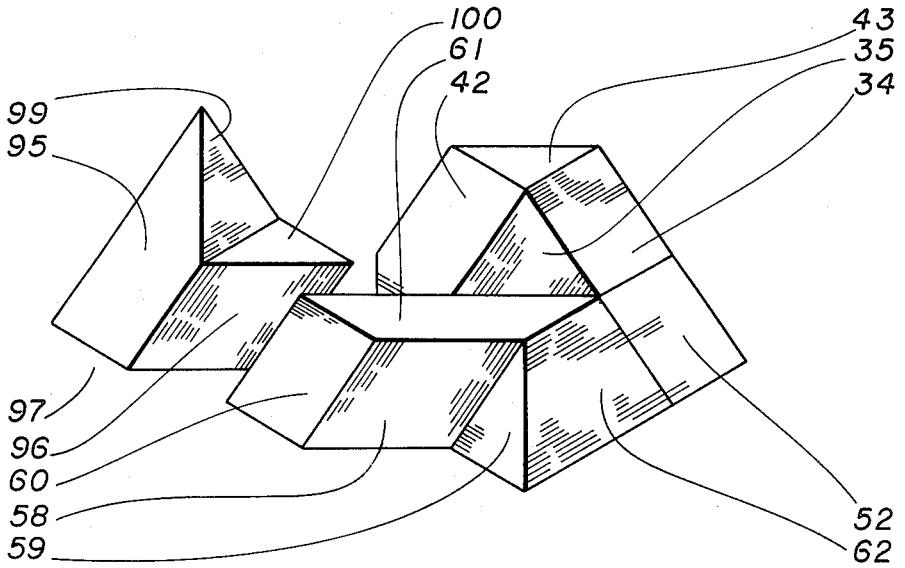

FIG. 59 shows the addition of modular unit C to the assembly. It rests on surface 97 forming its base. The remaining surfaces of modular unit C abut with the surfaces of modular units J and G as follows: C 102-J 40; C 101-J 42; and C 96-G 63.

Figure 60:
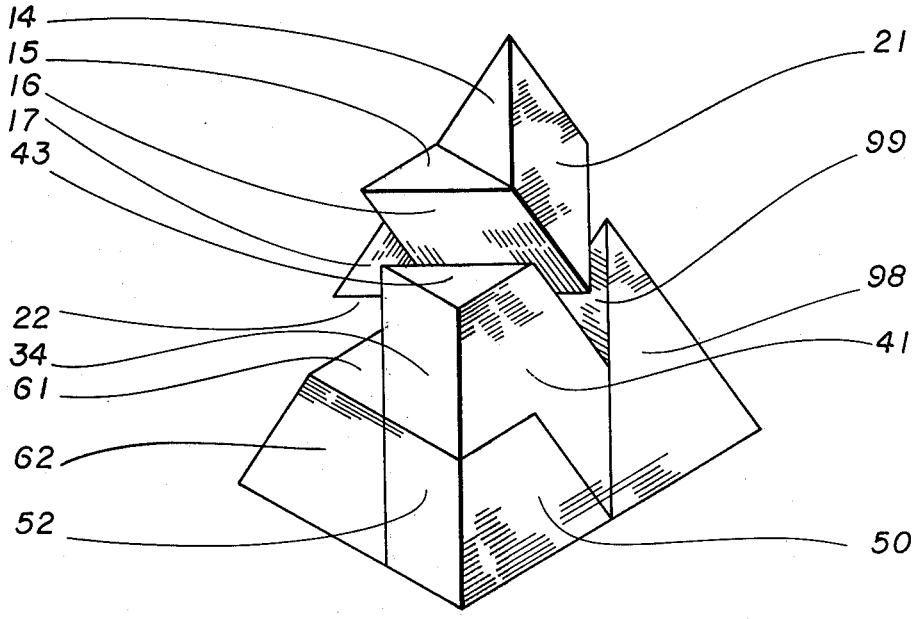

FIG. 60 shows the addition of modular unit L to the assembly. Planar surface 22 of modular unit L forms its base which rests on planar surface 100 of modular unit C. The remaining planar surfaces of modular unit L abut with surfaces of the other modular units as follows: L 20-C 99; L 22-C 100, G 61; and L 16-J 42.

Figure 61:
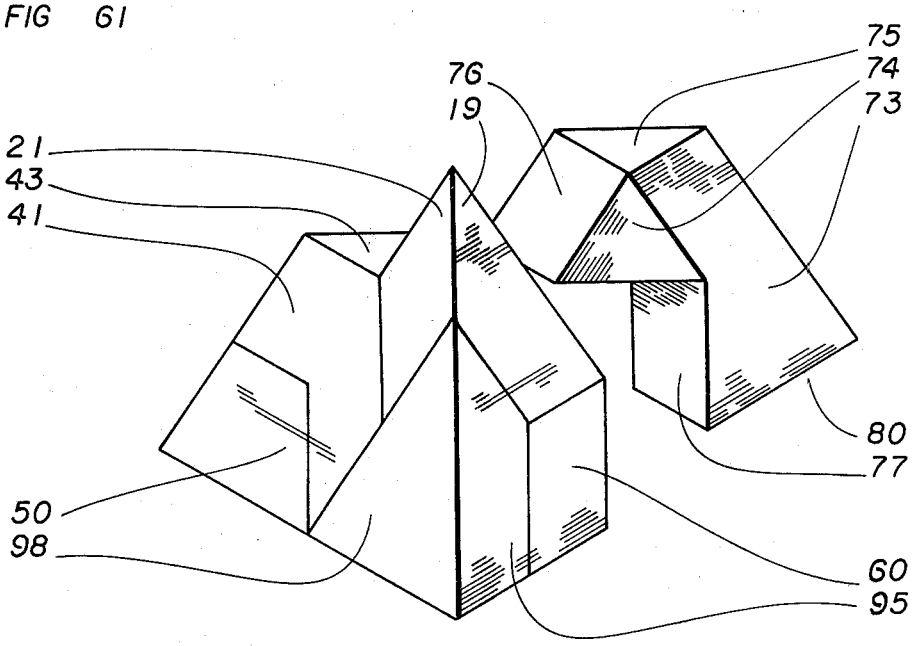

FIG. 61 shows the addition of modular unit E to the assembly with this unit resting on surface 80 which forms its base. The planar surfaces of modular unit E abut with the planar surfaces of the other modular units of the assembly as follows: E 76-L 18, J 35; E 78-G 61; E 77-G 58; and E 79-G 59.

Figure 62:
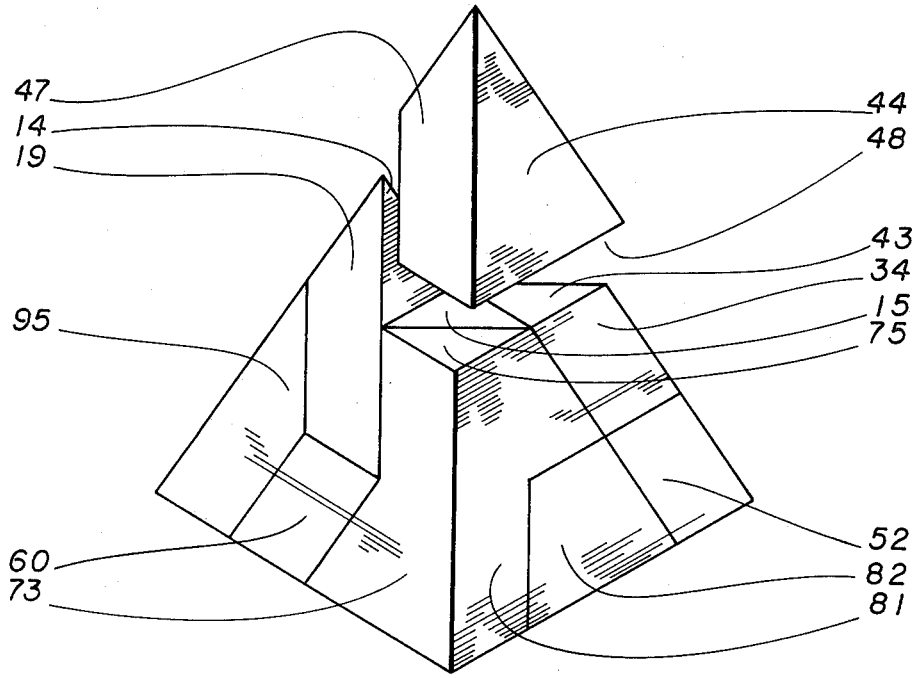

FIG. 62 shows the addition of modular unit I to the assembly previously described. Modular unit I rests on planar surface 48 which forms its base and has the remainder of its planar surfaces abutting planar surfaces of the other modular units as follows: I 46-L 14; I 48-E 75; L 15 and J 43.

Figure 63:
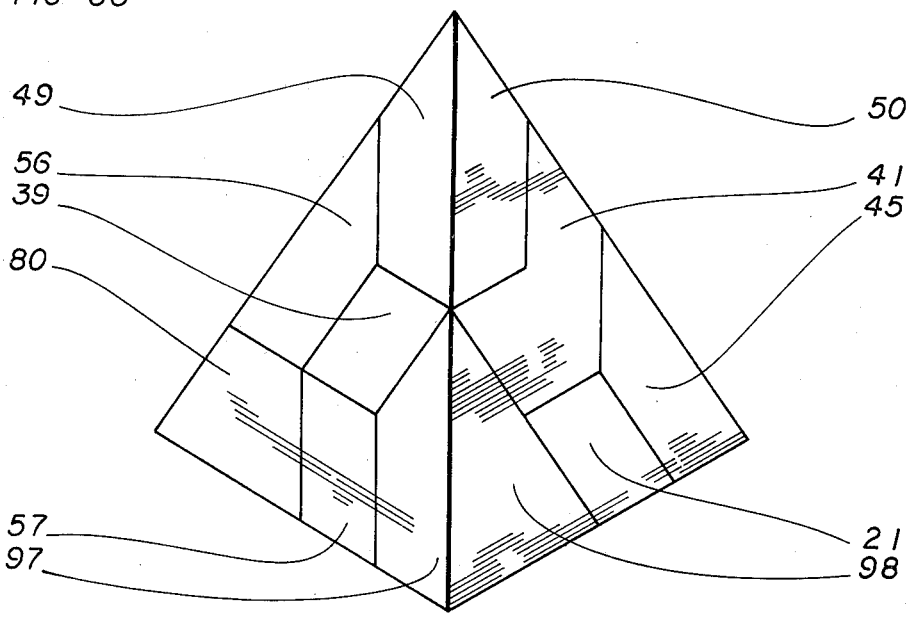
FIG. 63 shows another perspective view of the completed tetrahedron shown FIG. 62.

The completed solid tetrahedron is illustrated in two views in respective FIGS. 62 and 63.

As evident from the above, the modular units of the invention each have a unique and distinctive shape and can be interfit with one another to form a solid tetrahedron. When all thirteen modular units of the first embodiment are utilized, a larger solid tetrahedron can be formed, while predetermined ones of the thirteen modular units can be used to form a smaller solid tetrahedron in a second embodiment. However, it should be understood that the number of modular units required to form a solid tetrahedron can be varied as desired, as can the number of and locations of octrahedrons and tetrahedrons in each. The modular units can be used as an educational or amusement device, the object being to construct the solid tetrahedrons from the modular units, or the modular units can be conveniently used to construct random sculpture shapes. The modular units may be constructed of any suitable material, for example, wood, plastic, metal, cardboard, etc.

Although preferred embodiments of the modular units and solid tetrahedrons formed therefrom have been showed and described, it should be appreciated that various modifications can be made to the invention without departing from its spirit or scope. Accordingly, the invention is not to be limited by the foregoing description, but is only limited by the claims as appended hereto.

What is claimed is:

1. A three-dimensional amusement apparatus comprising a first plurality of three-dimensional modular units, each having a different shape defined by a plurality of exterior planar surfaces and being formed by an integral combination of at least one equilateral solid tetrahedron in face to face contact with at least one equilateral solid octrahedron, the planar faces of each said solid tetrahedron having the same size and shape as the planar faces of each said solid octrahedron, said plurality of modular units being shaped to permit their interengagement to form a first tetrahedron having a predetermined size.

2. An amusement apparatus as in claim 1 wherein said first tetrahedron is a solid equilateral tetrahedron.

3. An amusement apparatus as in claim 1 wherein a second plurality of individual three-dimensional modular units, which comprises some but not all of said first plurality of modular units, are shaped to permit their interengagement to form a second tetrahedron having a predetermined size smaller than that of said first tetrahedron.

4. An amusement apparatus as in claim 3 wherein said second tetrahedron is a solid equilateral tetrahedron.

5. An amusement apparatus as in claim 1 wherein thirteen three-dimensional modular units constitute said first plurality.

6. An amusement apparatus as in claim 1 wherein seven three-dimensional modular units constitute said first plurality.

7. An amusement apparatus as in claim 3 wherein thirteen three-dimensional modular units constitute said first plurality and seven of said thirteen modular units constitute said second plurality.

8. An amusement apparatus as in claim 1 wherein at least one of said modular units is formed by the integral combination of two solid octrahedrons and four solid tetrahedrons.

9. An amusement apparatus as in claim 1 wherein at least one of said modular units is formed by the integral combination of one solid octrahedron and four solid tetrahedrons.

10. An amusement apparatus as in claim 1 wherein at least one of said modular units is formed by the integral combination of one solid octrahedron and two solid tetrahedrons.

11. An amusement apparatus as in claim 1 wherein at least one of said modular units is formed by the integral combination of one solid octrahedron and three solid tetrahedrons.

12. An amusement apparatus as in claim 1 wherein at least one of said modular units is formed by the integral combination of two solid octrahedrons and three solid tetrahedrons.

13. An amusement apparatus as in claim 1 wherein at least one of said modular units is formed by the integral combination of two solid octrahedrons and two solid tetrahedrons.

14. An amusement apparatus as in claim 1 wherein at least one of said modular units is formed by the integral combination of two solid octrahedrons and five solid tetrahedrons.

15. An amusement apparatus as in claim 5 wherein said thirteen modular units are respectively formed by the integral combination of the following number of solid octrahedrons and solid tetrahedrons:

| unit number | solid octrahedrons | solid tetrahedrons |
|---|---|---|
| 1 | 2 | 4 |
| 2 | 1 | 4 |
| 3 | 1 | 4 |
| 4 | 2 | 4 |
| 5 | 2 | 4 |
| 6 | 1 | 2 |
| 7 | 2 | 4 |
| 8 | 1 | 3 |
| 9 | 1 | 3 |
| 10 | 2 | 3 |
| 11 | 2 | 2 |
| 12 | 1 | 3 |
| 13 | 2 | 5 |

16. An amusement apparatus as in claim 6 wherein said seven modular units are respectively formed by the integral combination of the following number of solid octrahedrons and solid tetrahedrons:

| unit number | solid octrahedrons | solid tetrahedrons |
|---|---|---|
| 1 | 1 | 3 |
| 2 | 2 | 4 |
| 3 | 2 | 3 |
| 4 | 1 | 4 |
| 5 | 1 | 3 |
| 6 | 2 | 4 |
| 7 | 1 | 3 |

17. An amusement apparatus as in claim 8 wherein one of said modular units is formed by two solid octrahedrons joined on an edge residing in an imaginary plane bisecting the two solid octrahedrons into upper and lower pyramid halves, each of said octrahedrons having first through fourth planar faces located above said imaginary plane taken in a counterclockwise direction beginning from a right hand edge residing in said imaginary plane, and fifth through eighth planar faces located below said imaginary plane taken in a counterclockwise direction beginning from said right hand edge, the first octrahedron having a face of a first solid tetrahedron integrally connected to the third planar face thereof and a face of a second solid tetrahedron integrally connected to the fifth planar face thereof, and the second octrahedron having a face of a third solid tetrahedron integrally connected to the second planar face thereof, a face of a fourth solid tetrahedron connected to the fifth planar face thereof, and a face of said second solid tetrahedron integrally connected to the seventh planar face thereof.

18. An amusement apparatus as in claim 8 wherein one of said modular units is formed by two solid octrahedrons joined on an edge residing in an imaginary plane bisecting the two solid octrahedrons into upper and lower pyramid halves, each of said octrahedrons having first through fourth planar faces located above said imaginary plane taken in a counterclockwise direction beginning from a right hand edge residing in said imaginary plane and fifth through eighth planar faces located below said imaginary plane taken in a counterclockwise direction beginning from said right and hand edge, the first octrahedron having a face of a first solid tetrahedron integrally connected to the first planar face thereof, and the second octrahedron having a face of said first solid tetrahedron integrally connected to the third planar face thereof, a face of a second solid tetrahedron integrally connected to the first planar face thereof, a face of a third solid tetrahedron integrally connected to the second planar face thereof, and a face of a fourth solid tetrahedron integrally connected to the eighth planar face thereof.

19. An amusement apparatus as in claim 8 wherein one of said modular units is formed by two solid octrahedrons joined on an edge residing in an imaginary plane bisecting the two solid octrahedrons into upper and lower pyramid halves, each of said octrahedrons having first through fourth planar faces located above said imaginary plane taken in a counterclockwise direction beginning from a right hand edge residing in said imaginary plane, and fifth through eighth planar faces located below said imaginary plane taken in a counterclockwise direction beginning from said right hand edge, the first octrahedron having a face of a first solid tetrahedron integrally connected to third planar face thereof, a face of a second solid tetrahedron integrally connected to the fifth planar face thereof, and the second octrahedron having a face of a third solid tetrahedron integrally connected to the second planar face thereof, a face of the second solid tetrahedron integrally connected to the seventh planar face thereof, and a face of a fourth solid tetrahedron integrally connected to the fifth planar face thereof.

20. An amusement apparatus as in claim 8 wherein one of said modular units is formed by two solid octrahedrons joined on an edge residing in an imaginary plane bisecting the two solid octrahedrons into upper and lower pyramid halves, each of said octrahedrons having first through fourth planar faces located above said imaginary plane taken in a counterclockwise direction beginning from a right hand edge residing in said imaginary plane, and fifth through eighth planar faces located below said imaginary plane taken in a counterclockwise direction beginning from said right hand edge, the first octrahedron having a face of a first solid tetrahedron integrally connected to the first planar face thereof, a face of a second solid tetrahedron integrally connected to the seventh planar face thereof, and the second octrahedron having a face of said first solid tetrahedron integrally connected to the third planar face thereof, a face of a third solid tetrahedron integrally connected to the fourth planar face thereof and a face of a fourth solid tetrahedron integrally connected to the fifth planar face thereof.

21. An amusement apparatus as in claim 9 wherein one of said modular units is formed by a solid octrahedron having first through fourth planar faces located above an imaginary plane bisecting said octrahedron into upper and lower pyramid halves and taken in a counterclockwise direction beginning from a right hand edge residing in said imaginary plane, and fifth through eighth planar faces located below said imaginary plane and taken in a counterclockwise direction beginning from said righthand edge, said octrahedron having four solid tetrahedrons with respective faces integrally connected to the first, second, third, and fifth planar faces thereof.

22. An amusement apparatus as in claim 9 wherein one of said modular units is formed by a solid octrahedron having first through fourth planar faces located above an imaginary plane bisecting said octrahedron into upper and lower pyramid halves and taken in a counterclockwise direction beginning from a right hand edge residing in said imaginary plane, and fifth through eighth planar faces located below said imaginary plane and taken in a counterclockwise direction beginning from said righthand edge, said octrahedron having four solid tetrahedrons with respective faces integrally connected to the first, second, sixth and eighth planar faces thereof.

23. An amusement apparatus as in claim 10 wherein one of said modular units is formed by a solid octrahedron having first through fourth planar faces located above an imaginary plane bisecting said octrahedron into upper and lower pyramid halves and taken in a counterclockwise direction beginning from a right hand edge residing in said imaginary plane, and fifth through eighth planar faces located below said imaginary plane and taken in a counterclockwise direction beginning from said righthand edge, said octrahedron having two solid tetrahedrons with respective faces integrally connected to the second and seventh planar faces thereof.

24. An amusement apparatus as in claim 11 wherein one of said modular units is formed by a solid octrahedron having first through fourth planar faces located above an imaginary plane bisecting said octrahedron into upper and lower pyramid halves and taken in a counterclockwise direction beginning from a right hand edge residing in said imaginary plane, and fifth through eighth planar faces located below said imaginary plane and taken in a counterclockwise direction beginning from said righthand edge, said octrahedron having three solid tetrahedrons with respective faces integrally connected to the third, fifth and seventh planar faces thereof.

25. An amusement apparatus as in claim 9 wherein one of said modular units is formed by a solid octrahedron having first through fourth planar faces located above an imaginary plane bisecting said octrahedron into upper and lower pyramid halves and taken in a counterclockwise direction beginning from a right hand edge residing in said imaginary plane, and fifth through eighth planar faces located below said imaginary plane and taken in a counterclockwise direction beginning from said righthand edge, said octrahedron having three solid tetrahedrons with respective faces integrally connected to the third, sixth and eight planar faces thereof.

26. An amusement apparatus as in claim 11 wherein one of said modular units is formed by a solid octrahedron having first through fourth planar faces located above an imaginary plane bisecting said octrahedron into upper and lower pyramid halves and taken in a counterclockwise direction beginning from a right hand edge residing in said imaginary plane, and fifth through eighth planar faces located below said imaginary plane and taken in a counterclockwise direction beginning from said right hand edge, said octrahedron having three solid tetrahedrons with respective faces intregrally connected to the fifth, sixth and seventh planar faces thereof.

27. An amusement apparatus as in claim 12 wherein one of said modular units is formed by two solid octrahedrons joined on an edge residing in an imaginary plane bisecting the two solid octrahedrons into upper and lower pyramid halves, each octrahedron having first through fourth planar faces located above said imaginary plane taken in a counterclockwise direction beginning from a right hand edge residing in said imaginary plane, and fifth through eighth planar faces located below said imaginary plane taken in a counterclockwise direction beginning from said right hand edge, the first octrahedron having a face of a first solid tetrahedron integrally connected to the first planar face thereof, and a face of a second solid tetrahedron integrally connected to the eighth planar face thereof, and the second octrahedron having a face of said first solid tetrahedron integrally connected to the third planar face thereof and a face of a third solid tetrahedron integrally connected to the sixth planar face thereof.

28. An amusement apparatus as in claim 13 wherein one of said modular units is formed by two solid octrahedrons joined on an edge residing in an imaginary plane bisecting the two solid octrahedrons into upper and lower pyramid halves, each of said octrahedrons having first through fourth planar faces located above said imaginary plane taken in a counterclockwise direction beginning from a right hand edge residing in said imaginary plane, and fifth through eighth planar faces located below said imaginary plane taken in a counterclockwise direction beginning from said right hand edge, the first solid octrahedron having a face of a first and second solid tetrahedron respectively integrally connected to the first and third planar faces thereof, and the second octrahedron having a face of said first solid tetrahedron integrally connected to the third planar face thereof.

29. An amusement apparatus as in claim 13 wherein one of said modular units is formed by two solid octrahedrons joined on an edge residing in an imaginary plane bisecting the two solid octahedrons into upper and lower pyramid halves, each of said octrahedrons having first through fourth planar faces located above said imaginary plane taken in a counterclockwise direction beginning from a right hand edge residing in said imaginary plane, and fifth through eighth planar faces located below said imaginary plane taken in a counterclockwise direction beginning from said right hand edge, the first octrahedron having faces of first and second solid tetrahedrons respectively integrally connected to the first and fifth planar faces thereof, the second octrahedron having faces of said first and second solid tetrahedrons respectively integrally connected to the third and seventh planar faces thereof, and the faces of third, fourth and fifth solid tetrahedrons respectively integrally connected to the second, fourth and eighth planar faces thereof.

* * * * *